US012582281B2

(12) United States Patent
Park et al.

(10) Patent No.: US 12,582,281 B2
(45) Date of Patent: Mar. 24, 2026

(54) CUP WASHER

(71) Applicant: LG ELECTRONICS INC., Seoul (KR)

(72) Inventors: Charyeom Park, Seoul (KR); Miseong Kim, Seoul (KR); Changwoo Sung, Seoul (KR); Taeyong Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 24 days.

(21) Appl. No.: 18/372,332

(22) Filed: Sep. 25, 2023

(65) Prior Publication Data

US 2024/0099543 A1 Mar. 28, 2024

(30) Foreign Application Priority Data

Sep. 26, 2022 (KR) ..... 10-2022-0121431
Jun. 9, 2023 (KR) ..... 10-2023-0074415

(51) Int. Cl.

| | |
|---|---|
| ***A47L 15/00*** | (2006.01) |
| ***A47L 15/18*** | (2006.01) |
| ***A47L 15/23*** | (2006.01) |
| ***A47L 15/42*** | (2006.01) |

(52) U.S. Cl.

CPC ..... *A47L 15/0065* (2013.01); *A47L 15/0076* (2013.01); *A47L 15/18* (2013.01); *A47L 15/23* (2013.01); *A47L 15/4278* (2013.01); *A47L 15/428* (2013.01); *A47L 15/0089* (2013.01); *A47L 15/4285* (2013.01)

(58) Field of Classification Search

None

See application file for complete search history.

(56) References Cited

U.S. PATENT DOCUMENTS

| | | | |
|---|---|---|---|
| 3,465,761 | A | 9/1969 | Meeker et al. |
| 4,832,064 | A | 5/1989 | Nezworski |
| 6,581,614 | B1 | 6/2003 | Gotfried |
| 2014/0216507 | A1 | 8/2014 | Pyo |
| 2020/0034688 | A1 | 1/2020 | Lim et al. |
| 2022/0104681 | A1 | 4/2022 | Beck et al. |
| 2022/0104981 | A1 | 4/2022 | Jones |

FOREIGN PATENT DOCUMENTS

| | | | |
|---|---|---|---|
| AU | 24310 71 | A | 7/1972 |
| CN | 110730625 | A | 1/2020 |
| CN | 111973120 | A | 11/2020 |
| CN | 212213682 | U | 12/2020 |
| CN | 215650973 | U | 1/2022 |
| CN | 216020886 | U | 3/2022 |
| DE | 1 916 677 | U | 5/1965 |
| DE | 42 33 934 | A1 | 4/1994 |

(Continued)

*Primary Examiner* — Levon J Shahinian

(74) *Attorney, Agent, or Firm* — Birch, Stewart, Kolasch & Birch, LLP

(57) ABSTRACT

A cup washer includes a tub providing a space in which a cup is accommodated, and a sprayer disposed on the tub and configured to spray water toward the cup. The sprayer includes a first spray nozzle and a second spray nozzle coupled to the first spray nozzle. The second spray nozzle is disposed on a central portion of the first spray nozzle. The first spray nozzle extends away from an outer circumference of the second spray nozzle. The first spray nozzle is rotatable around the second spray nozzle.

19 Claims, 30 Drawing Sheets

(56) References Cited

FOREIGN PATENT DOCUMENTS

| | | | |
|---|---|---|---|
| EP | 2 559 369 | A2 | 2/2013 |
| EP | 2 656 772 | A2 | 10/2013 |
| GE | 1 526 092 | A | 9/1978 |
| JP | 9-215653 | A | 8/1997 |
| JP | 11-290261 | A | 10/1999 |
| JP | 2003-24261 | A | 1/2003 |
| JP | 2010-36023 | A | 2/2010 |
| JP | 2016-98331 | A | 5/2016 |
| KR | 10-2006-0068402 | A | 6/2006 |
| KR | 10-0686198 | B1 | 2/2007 |
| KR | 10-0700539 | B1 | 3/2007 |
| KR | 10-2009-0022896 | A | 3/2009 |
| KR | 10-2012-0022222 | A | 3/2012 |
| KR | 10-2013-0040919 | A | 4/2013 |
| KR | 10-2014-0099692 | A | 8/2014 |
| KR | 10-2014-0101631 | A | 8/2014 |
| KR | 10-2017-0012945 | A | 2/2017 |
| KR | 10-1803315 | B1 | 11/2017 |
| KR | 10-2019-0099151 | A | 8/2019 |
| KR | 10-2052837 | B1 | 12/2019 |
| KR | 10-2020-0016470 | A | 2/2020 |
| KR | 10-2114048 | B1 | 5/2020 |
| KR | 10-2021-0063953 | A | 6/2021 |
| KR | 10-2021-0069541 | A | 6/2021 |
| KR | 10-2283226 | B1 | 7/2021 |
| KR | 10-2395273 | B1 | 5/2022 |
| WO | WO 03/011486 | A1 | 2/2003 |
| WO | WO 2013/036468 | A1 | 3/2013 |
| WO | WO 2022/164158 | A2 | 8/2022 |
| WO | WO 2022/194952 | A1 | 9/2022 |

CUP WASHER

CROSS-REFERENCE TO RELATED APPLICATION

This application claims priority to and benefit of Korean Patent Applications No. 10-2022-0121431, filed on Sep. 26, 2022, and 10-2023-0074415, filed on Jun. 9, 2023, which are hereby incorporated by reference as if fully set forth herein.

BACKGROUND

Technical Field

The present disclosure relates to a cup washer, and more specifically, to a cup washer for washing a cup carried by a user.

Background Art

Contents described in this section simply provide background information on the present disclosure and do not constitute the related art.

Recently, in order to prevent environmental pollution, the frequency of provision of disposable cups to customers is reduced at stores where beverages are sold, and the trend in which a customer who visits a store carries a multi-use cup, such as a tumbler, and takes out the multi-use cup filled with a beverage is increasing.

In order to provide convenience to customers, that is, users of multi-use cups, it is necessary to provide a cup washer for washing a cup carried by the user in a store and allow the user to conveniently wash the cup carried by the user.

In order to cleanly wash the cup, a spray device for spraying water toward the cup may be provided in the cup washer. Korean Patent Application Laid-Open No. 10-2014-0099692, which is the related art, discloses a configuration of a dishwasher and a spray nozzle for spraying washing water provided in the dishwasher.

However, the related art discloses the spray nozzle provided in the dishwasher for washing various types of tableware rather than a cup washer. Since the cup washer is smaller than the dishwasher, a space available for fixing the spray nozzle and implementing an operating form is limited. Therefore, a problem that the form applied to the related art may not be applied to a narrow space occurs.

In addition, the cup washer may be operated in a rapid washing mode in which a cup is washed quickly or a normal washing mode in which it takes some time for a cup to be cleanly washed according to a user's selection.

Therefore, the cup washer should be able to implement both spraying water by being directly connected to a city water supply and spraying water by forming a circulation flow path through a pump according to the washing mode of the rapid washing mode and the normal washing mode. However, the dishwasher disclosed in the related art has a limitation in that the dishwasher may not implement the rapid washing mode of the cup washer because it has only a structure of spraying water with a pump after water is stored due to its characteristics. A solution for this is needed.

In addition, it is necessary to design a cup washer having a structure of entirely and cleanly washing a cup by washing both an inside of the cup in which water, a beverage, or the like is contained and an outside of the cup that is contactable with the user's hand.

SUMMARY

The present disclosure is directed to providing a cup washer including a spray unit having a structure capable of effectively washing one cup.

In addition, the present disclosure is also directed to providing a cup washer including a spray unit having a structure that may be mounted on the cup washer having a relatively smaller volume than a general dishwasher.

In addition, the present disclosure is directed to providing a cup washer having a structure capable of implementing both a normal washing mode and a rapid washing mode.

In addition, the present disclosure is directed to providing a cup washer having a structure capable of entirely and cleanly washing a cup.

Objects of the present disclosure are not limited to the above-described objects, and other objects and advantages of the present disclosure that are not mentioned can be understood by the following description and more clearly understood by embodiments of the present disclosure. In addition, it will be able to be easily seen that the objects and advantages of the present disclosure may be achieved by devices and combinations thereof that are described in the claims.

A cup washer may include a washing unit. One embodiment of the washing unit includes a spray unit accommodated in a tub, coupled to a sump, and configured to spray water toward a cup, wherein the spray unit includes a first spray nozzle of which a longitudinal direction is disposed in a lateral direction of the tub, and a second spray nozzle disposed on a central portion of the first spray nozzle. The first spray nozzle may be provided to rotate, and the second spray nozzle may not rotate.

Therefore, the first spray nozzle may spray water to an outer surface of the cup while rotating, and the second spray nozzle may effectively spray water to an inner surface of the cup. Therefore, the inner surface and the outer surface of the cup may be effectively washed using the first spray nozzle and the second spray nozzle.

The first spray nozzle may include a first piece forming an upper portion of the first spray nozzle, and the first piece may include a plurality of first spray holes symmetrically disposed based on a rotation center of the first spray nozzle. The first spray holes may be provided so that water discharge directions are inclined in a vertical direction and a lateral direction of the tub.

With this structure, when water is discharged from the first spray holes, the water may be sprayed in directions inclined with respect to the vertical direction and the lateral direction of the tub and diffused in the entire space inside the tub.

When the cup washer operates in a normal washing mode, water supplied from the sump may be sprayed through the first spray nozzle, and the first spray nozzle may wash the cup while rotating. When the cup washer operates in a rapid washing mode, water may be sprayed through the second spray nozzle. The cup washer can improve a user's convenience by operating separately in the normal washing mode and the rapid washing mode.

At least a portion of the second spray nozzle may be disposed inside the cup, and at least a portion of the first spray nozzle may be disposed outside the cup. Therefore, water sprayed from the spray unit may reach both the inner surface and the outer surface of the cup.

With this structure, water sprayed from a spray device may collide with both the inner surface and the outer surface of the cup to wash the surfaces of the cup with remained foreign substances.

The washing unit according to one embodiment may include a tub providing a space in which a cup is accommodated, and a spray unit disposed on the tub to spray water toward the cup, wherein the spray unit includes a second spray nozzle extending in a vertical direction and including at least one spray hole, and a first spray nozzle extending from an outer circumference of the second spray nozzle toward both side surfaces of the tub, including at least one spray hole, and provided to rotate around the second spray nozzle.

The spray unit may include a first bracket to which the first spray nozzle is rotatably coupled, and a second bracket to which the second spray nozzle is fixedly coupled, on which the first bracket is mounted, and which is coupled to a lower portion of the tub.

The first spray nozzle may include a plurality of first spray holes formed in an upper surface thereof and disposed to be spaced apart from each other at positions outward from a rotation center thereof, and water discharge directions of the plurality of first spray holes may be provided to be inclined in opposite directions based on the rotation center of the first spray nozzle.

The first spray nozzle may include second spray holes formed in a lower surface thereof, disposed to be spaced apart from each other at positions outward from the rotation center thereof, and disposed so that water discharge directions are positioned in opposite direction based on the rotation center of the first spray nozzle.

The second spray nozzle may be provided to extend upward to be higher than the upper surface of the first spray nozzle.

The second spray nozzle may include a first protrusion protruding upward from the first spray nozzle and including a plurality of third spray holes disposed to be spaced apart from each other in a circumferential direction thereof, and a second protrusion coupled to the first protrusion, protruding upward from the first protrusion and having a fourth spray hole provided in an upper end portion thereof.

The fourth spray hole may include a plurality of first sub spray holes disposed to be spaced apart from each other in a sidewall of the second protrusion in a circumferential direction thereof, and second sub spray holes formed in an upper cover provided in an upper end of the fourth spray hole and disposed to be spaced apart from each other in a diameter direction and a circumferential direction of the upper cover.

The second spray nozzle may be provided to extend upward after passing through the central portion of the first spray nozzle, the first spray nozzle may be connected to the first flow path along which water flows, and the second spray nozzle may be connected to a second flow path which is separated from the first flow path and along which water flows.

The first flow path may be formed between an outer surface of the second spray nozzle and an inner surface of the first spray nozzle and provided to surround the second flow path.

The first spray nozzle may include a first piece forming an upper portion of the first spray nozzle, and a second piece forming a lower portion of the first piece and coupled to the first piece to form a space in which water flows.

The first spray nozzle may include a flow path forming unit formed to protrude downward from the second piece, provided to surround at least a portion of the second spray nozzle, and forming a flow path along which water flows into the first spray nozzle, and the first bracket may include a first coupling unit formed with a hole into which the flow path forming unit is inserted and provided to surround the flow path forming unit, and a second coupling unit provided in a flange shape by protruding in a diameter direction of the first coupling unit and coupled to the second bracket.

A first insertion hole into which the second spray nozzle is inserted may be formed in the central portion of the first piece, the first piece may include a stopper surrounding the first insertion hole and protruding upward, and the second spray nozzle may include a stepped surface formed at a position facing the stopper.

The second bracket may include a first body to which the second spray nozzle is coupled and formed with a flow path along which water sprayed through the second spray nozzle flows, a second body extending in a diameter direction of the first body and coupled to the tub, and a third body connecting the first body to the second body and provided with a first through hole forming a flow path communicating with the flow path forming unit, and the tub may include a second insertion hole which is connected to the first through hole and into which the first body is inserted, and a first mounting unit which is disposed to surround the second insertion hole and protrudes upward and on which the second body is mounted.

The washing unit may include a rack provided inside the tub and on which the cup is seated, and at least a portion of the second spray nozzle may be provided to protrude upward after passing through a lower end of the rack.

When the cup is seated on the rack, at least portions of both end portions of the first spray nozzle may be disposed outside the cup, and at least a portion of the second spray nozzle may be disposed inside the cup.

When the cup is seated on the rack, at least some of the plurality of spray holes formed in the second spray nozzle may be provided to be positioned inside the cup.

The washing unit according to another embodiment includes a tub providing a space in which a cup is accommodated, a second spray nozzle extending in a vertical direction and including at least one spray hole, and a first spray nozzle extending from an outer circumference of the second spray nozzle toward both side surfaces of the tub and including at least one spray hole, a first flow path is formed in a space between the outer circumference of the second spray nozzle and the first spray nozzle, and a second flow path partitioned from the first flow path may be formed in an internal space of the second spray nozzle.

The first flow path may be provided to surround an outer circumference of the second flow path.

The cup washer may further include a water tank disposed under the washing unit to store water for washing the cup, wherein the first flow path and the second flow path may receive water from at least one of a city water supply or the water tank.

The first flow path may receive water from the water tank, and the second flow path may receive water from the city water supply.

The first flow path and the second flow path may receive water from the water tank.

The cup washer may operate in any one of a normal washing mode or a rapid washing mode that requires a shorter time than in the normal washing mode, and water may be supplied to the first flow path when the cup washer operates in the normal washing mode.

When the cup washer operates in the normal washing mode, water may be provided to be supplied to the first flow path and the second flow path.

When the cup washer operates in the rapid washing mode, water may be supplied to the second flow path and may not be supplied to the first flow path.

The cup washer may further include a bubble generator which is disposed between a city water supply pipe and the second flow path and through which water introduced from the city water supply passes.

The second spray nozzle may be provided to extend upward after passing through a central portion of the first spray nozzle, and the first spray nozzle may be provided to rotate around the second spray nozzle.

The cup washer may further include a first bracket to which the first spray nozzle is rotatably coupled and a second bracket to which the second spray nozzle is fixedly coupled, on which the first bracket is mounted, and which is coupled to a lower portion of the tub to mount the spray unit on the tub.

In the cup washer according to the present disclosure, the spray unit may include a first spray nozzle configured to spray water to the cup while rotating, and a second spray nozzle not rotating but disposed at a position adjacent to the inner surface of the cup. Therefore, the inner surface and the outer surface of the cup may be effectively washed using the first spray nozzle and the second spray nozzle.

In addition, in the cup washer according to the present disclosure, the first spray holes may be provided so that water discharge directions are inclined in a vertical direction and a lateral direction of the tub. With this structure, when water is discharged from the first spray holes, the water may be sprayed in directions inclined with respect to the vertical direction and the lateral direction of the tub and spread in the entire space inside the tub. Therefore, even when the first spray nozzle has a relatively smaller size, water may be effectively sprayed throughout the tub, thereby increasing cup washing efficiency.

In addition, in the cup washer according to the present disclosure, water may be sprayed from the third spray holes and the first sub spray holes in the lateral direction of the second spray nozzle, and water may be sprayed from the second sub spray holes upward of the second spray nozzle, and thus water may be sprayed three-dimensionally from the second spray nozzle to effectively wash the inner surface of the cup.

In addition, in the cup washer according to the present disclosure, since the first spray nozzle is disposed under a detergent inlet and a rinse inlet, detergent and rinse flowing down along the inner wall of the tub from the detergent inlet and the rinse inlet may collide with the water sprayed from the second spray holes. The detergent and the rinse may be effectively mixed with the water due to the collision with the water. Therefore, it is possible to actively mix detergent or rinse with water, thereby increasing washing efficiency in the cup washer.

In addition, in the cup washer according to the present disclosure, the cup may be washed using the first spray nozzle in the normal washing mode, and the cup may be washed using the second spray nozzle in the rapid washing mode. At this time, flow paths of water in each mode may be separated. As described above, since the cup washer is operated separately in the normal washing mode and the rapid washing mode, it is possible to improve a user's convenience.

In addition, in the cup washer according to the present disclosure, both the inner surface of the cup containing water, beverages, or the like and the outer surface of the cup touched by a user's hand may be exposed to the water sprayed from the first spray nozzle and the second spray nozzle, and the water may collide with both the inner surface and the outer surface of the cup. Therefore, the cup washer may entirely and cleanly wash the inner surface and the outer surface of the cup at the same time.

In addition, in the cup washer according to the present disclosure, in the normal washing mode, water may flow through the first flow path to wash the cup using the first spray nozzle, and in the rapid washing mode, water may flow through the second flow path to wash the cup using the second spray nozzle.

In this case, the first flow path and the second flow path may be separated so that water flowing through each flow path may not be mixed. Therefore, it is possible to improve a user's convenience by operating the cup washer by clearly distinguishing between the normal washing mode and the rapid washing mode.

In addition, in the cup washer according to the present disclosure, the spray unit may include a first spray nozzle configured to spray water to the cup while rotating, and a second spray nozzle not rotating but disposed at a position adjacent to the inner surface of the cup.

The first spray nozzle may be connected to the first flow path, and the second spray nozzle may be connected to the second flow path. With this structure, the spray unit may perform a washing operation using the first spray nozzle in the normal washing mode and perform the washing operation using the second spray nozzle in the rapid washing mode.

Therefore, in the spraying unit, flow paths through which water flows may be separated in the normal washing mode and the rapid washing mode to smoothly operate in each mode, thereby increasing the washing efficiency of the cup washer.

In addition, in the cup washer according to the present disclosure, at least one of a bubble generator or an auxiliary heater may be provided on a pipe connecting a city water supply pipe to the second spray nozzle. Therefore, since the water sprayed from the second spray nozzle includes bubbles or is hot water, or is at least one state in the rapid washing mode, it is possible to effectively increase the washing efficiency of the cup washer in the rapid wash mode.

Specific effects together with the above-described effects are described together with a description of the following detailed matters for carrying out the disclosure.

MODES OF THE INVENTION

Figure 1:
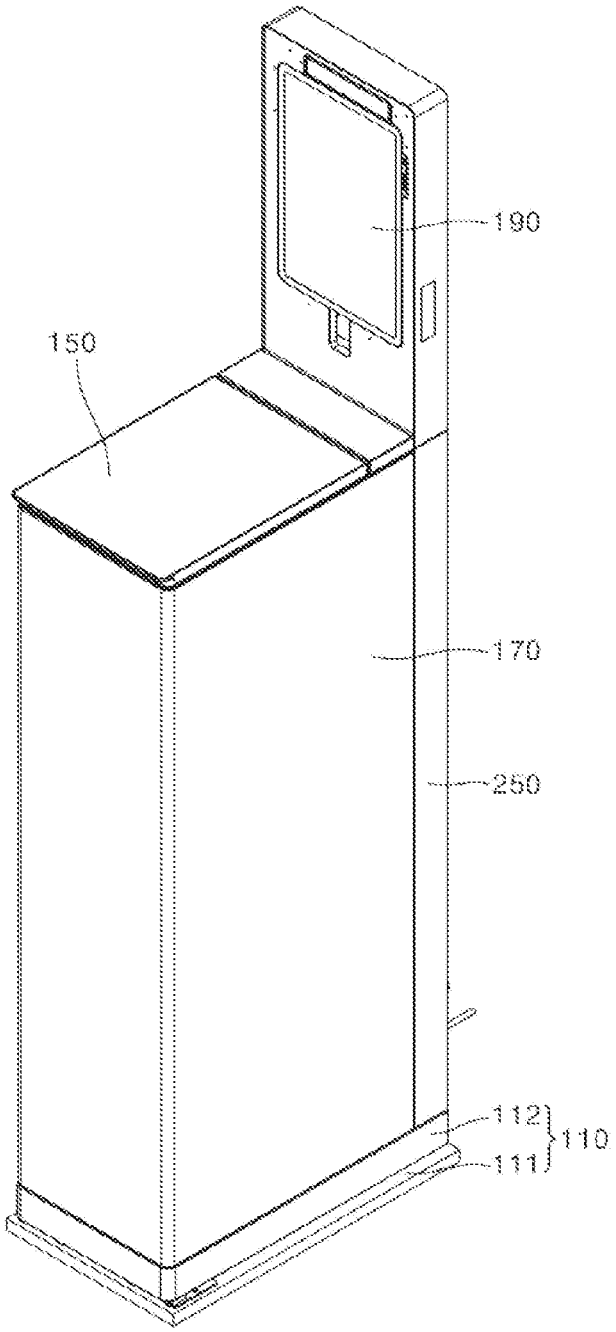
FIG. 1 is a perspective view illustrating a cup washer according to one embodiment.

The above-described objects, features, and advantages will be described below in detail with reference to the accompanying drawings, and thus those skilled in the art to which the present disclosure pertains will be able to easily carry out the technical spirit of the present disclosure. In describing the present disclosure, when it is determined that a detailed description of the known technology related to the present disclosure may unnecessarily obscure the gist of the present disclosure, a detailed description thereof will be omitted. Hereinafter, preferred embodiments according to the present disclosure will be described in detail with reference to the accompanying drawings. In the drawings, the same reference numerals are used to indicate the same or similar components.

Although first, second, etc. are used to describe various components, it goes without saying that these components are not limited by these terms. These terms are only used to distinguish one component from another component, and unless otherwise stated, it goes without saying that the first component may also be the second component.

Throughout the specification, unless otherwise stated, each component may be provided as one or more components.

The singular expression used herein includes the plural expression unless the context clearly dictates otherwise. In the application, terms such as "composed of" or "comprising" should not be construed as necessarily including all of the various components or operations described in the specification and should be construed as not including some of the components or some of the operations or further including additional components or operations.

Throughout the specification, when "A and/or B" is described, this means A, B, or A and B unless otherwise specified, and when "C to D" is described, this means C or more and D or less unless otherwise specified.

Throughout the specification, the term "vertical direction" is a vertical direction of a cup washer in a state in which the cup washer is installed for daily use. The term "lateral direction" is a direction orthogonal to the vertical direction, and the term "front-rear direction" is a direction perpendicular to both the vertical direction and the lateral direction. The term "both side directions" or "side direction" has meaning including the lateral direction and the front-rear direction.

Figure 2:
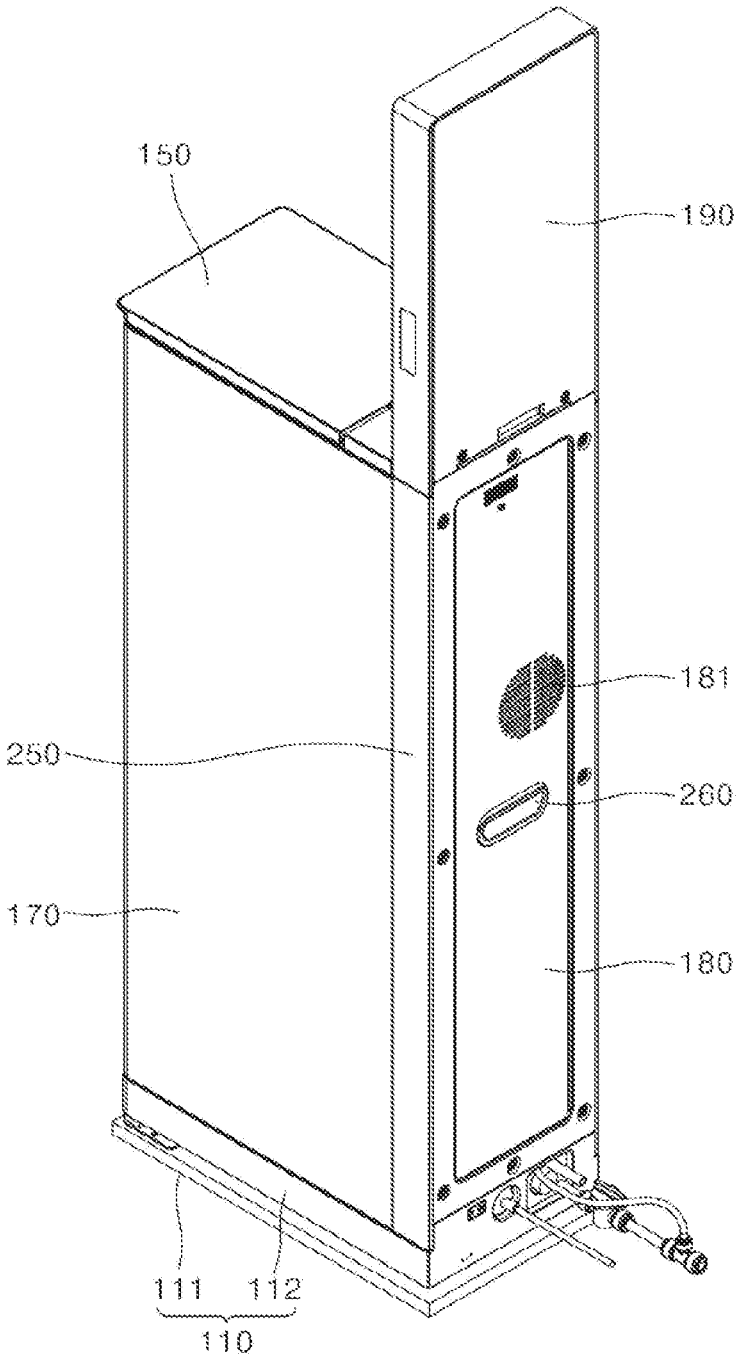
FIG. 2 is a view illustrating the cup washer of FIG. 1 in another direction.

FIG. 1 is a perspective view illustrating a cup washer according to one embodiment. FIG. 2 is a view illustrating the cup washer of FIG. 1 in another direction.

The cup washer according to the embodiment may be provided, for example, in stores where beverages are provided. Users of the cup washer may be customers who buy and drink beverages. In order to protect an environment, provision of disposable cups to customers in service stores has recently been restricted, and a range of such a restriction is gradually expanding.

Therefore, a cup washer may be provided in a service store so that users who carry multi-use cups may use a cup after washing the cup in the service store. A cup to be washed may be a multi-use cup such as a tumbler carried by a user. Therefore, the cup washer may have a structure which may be used conveniently by a user.

A washing unit 130 (See FIG. 4) for accommodating and washing a cup may be provided on an upper portion of the cup washer. The washing unit 130 may be opened or closed by a door 150. At this time, the door 150 may open and close the washing unit 130 by hinge-rotating in a vertical direction of the cup washer.

With this structure, a user may conveniently wash a cup without bending a waist by manually operating the cup washer after opening the door 150 to put the cup on the washing unit 130 and re-closing the door 150.

A height of the washing unit 130 in the cup washer needs to be appropriately adjusted to fit an adult's body so that the user may use the cup washer without bending down. In addition, in order to increase space efficiency, the cup washer needs to have a relatively smaller volume.

For this reason, the cup washer may have a tower-like shape with a relatively smaller planar cross-sectional area and a relatively larger vertical length. Due to the tower-like shape, relatively larger components in the cup washer need to be disposed in a vertical direction.

In addition, due to the tower-shaped shape, risk in which tipping over of the cup washer occurs, and in order to suppress the tipping over of the cup washer, it is necessary to lower the overall center of gravity by arranging a relatively heavier part on a lower portion of the cup washer.

Figure 3:
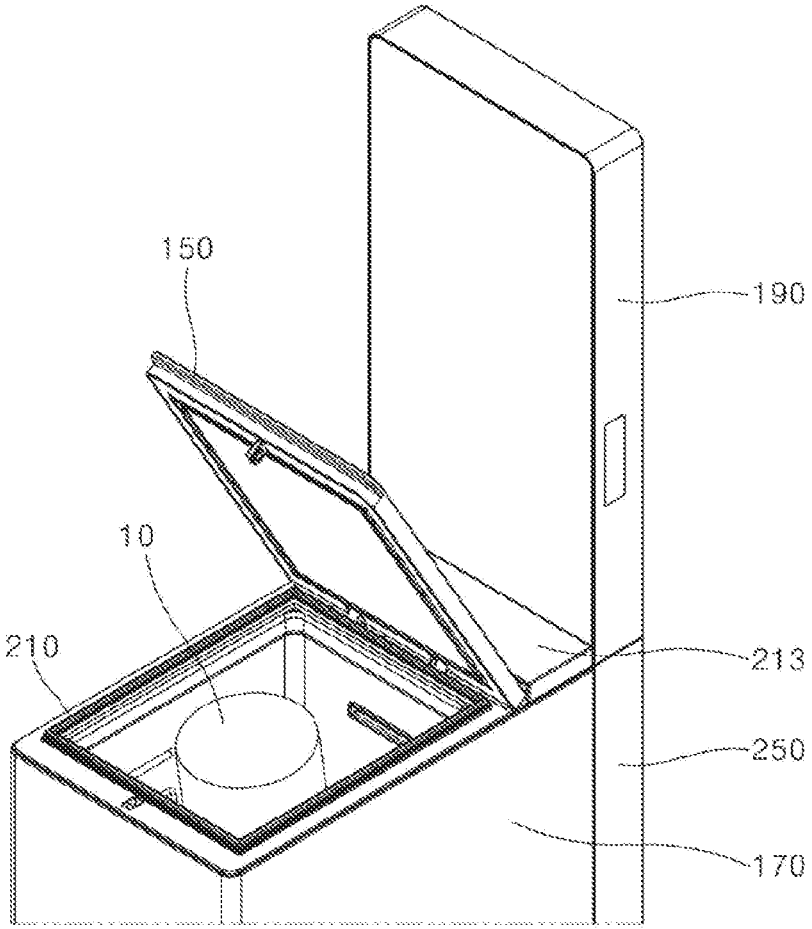
FIG. 3 is a view illustrating a state in which a floor is open in the cup washer according to one embodiment.
Figure 4:
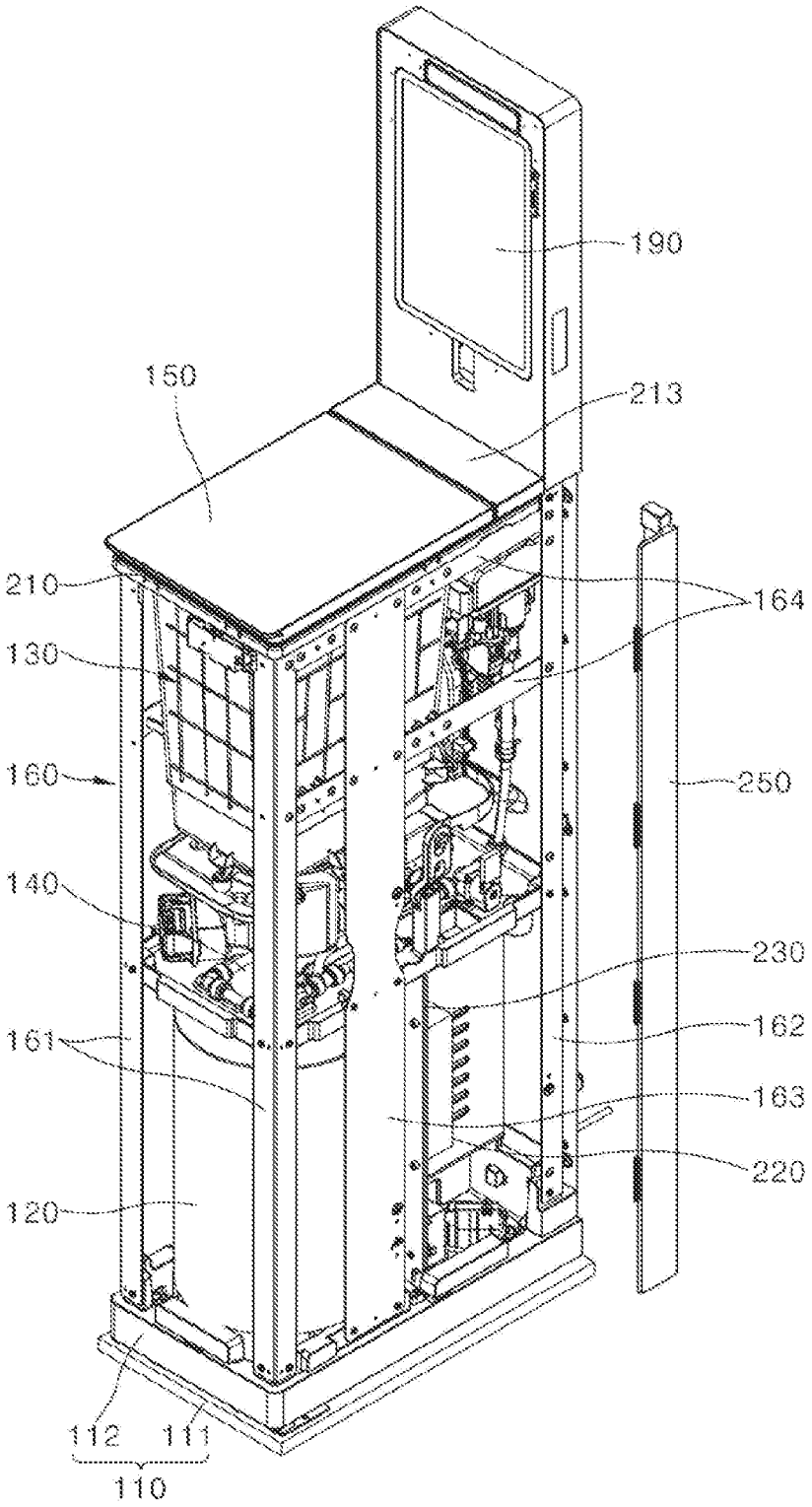
FIG. 4 is a perspective view illustrating the cup washer from which some components are omitted.
Figure 5:
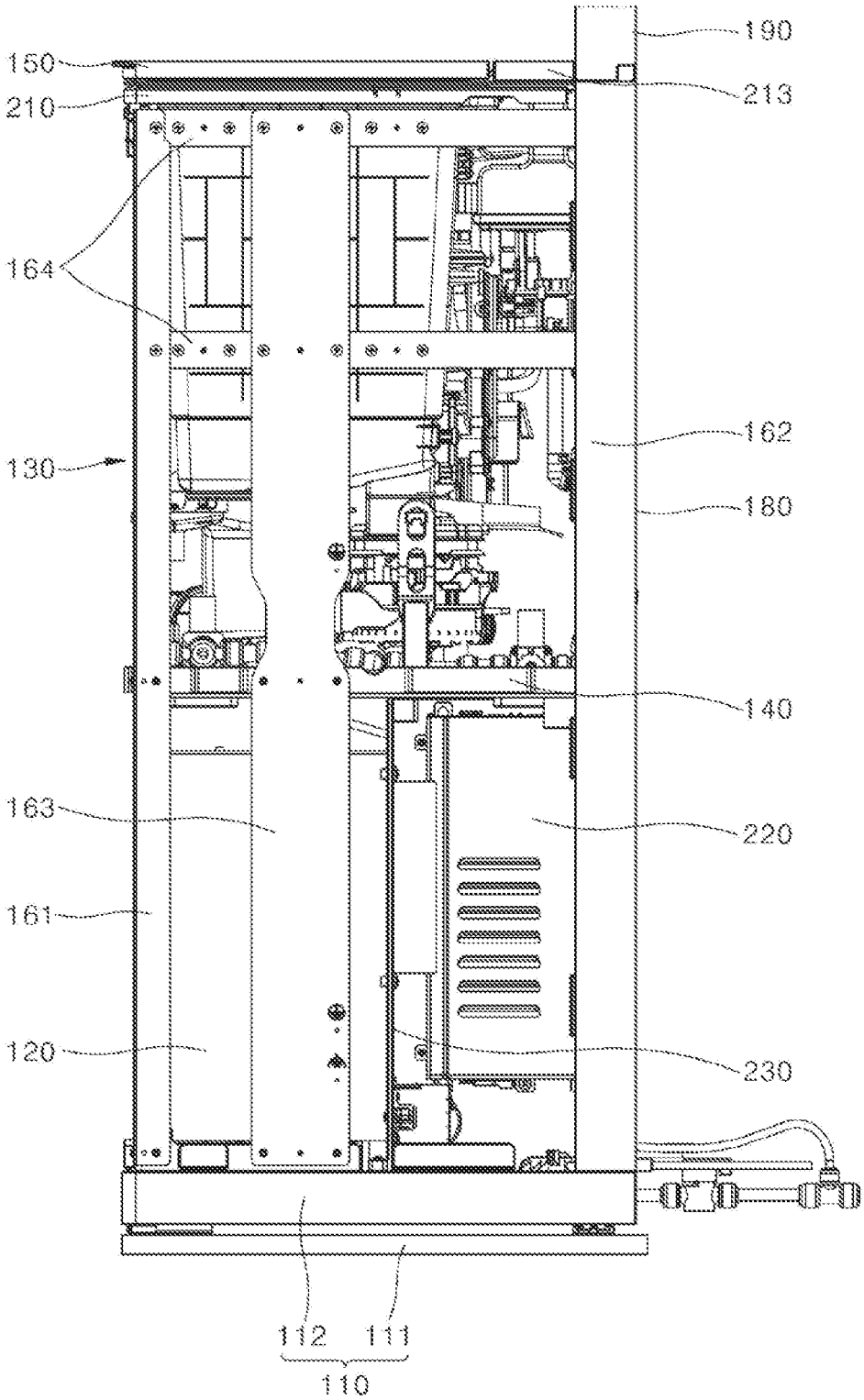
FIG. 5 is a side view illustrating the cup washer of FIG. 4.

Hereinafter, the structure of the cup washer will be described in more detail with reference to the drawings. FIG. 3 is a view illustrating a state in which the door 150 is open in the cup washer according to one embodiment. FIG. 4 is a perspective view illustrating the cup washer from which some components are omitted. FIG. 5 is a side view illustrating the cup washer of FIG. 4.

The cup washer according to one embodiment may include a base plate 110, a water tank 120, the washing unit 130, an intermediate plate 140, the door 150, and a frame 160.

The base plate 110 may be disposed on a lowermost portion of the cup washer to support other components of the cup washer. A lower portion of the base plate 110 may be disposed on the ground. The base plate 110 may include a first part 111 and a second part 112. The first part 111 may have a lower surface disposed on the ground and support the second part 112.

The second part 112 may be disposed above the first part 111, and the water tank 120 may be disposed on the second part 112. The frame 160 may be coupled to the second part 112. For example, a front support 161, a rear support 162, and an intermediate support 163 may be coupled to the second part 112. Therefore, the frame 160 may be supported by the second part 112.

The water tank 120 may be disposed above the base plate 110 and under the washing unit 130 and may store water for washing a cup. The water tank 120 may be connected to a city water supply using a pipe. Therefore, water of the city water supply may flow into the water tank 120 and may be stored therein. In addition, the water tank 120 may be connected to the washing unit 130 using a pipe. Therefore, water in the water tank 120 may flow into the washing unit 130 and may be used to wash a cup accommodated in the washing unit 130.

A heating device may be provided inside the water tank 120. The water in the water tank 120 may be heated by the heating device and flow into the washing unit 130. Therefore, it is possible to increase washing efficiency for the cup by washing the cup using the heated water.

In another embodiment, by stopping the operation of the heating device, room temperature water may flow into a tub 131 of the washing unit 130 from the water tank 120. In this case, the cup may be washed using the room temperature water.

The water tank 120 may be fully filled with water. Therefore, the water tank 120 fully filled with water may have a relatively larger load than other components. The water tank 120 may be disposed on the base plate 110 and disposed on the lower portion of the cup washer.

Due to the load of the water tank 120 fully filled with water disposed on the lower portion of the cup washer, the overall center of gravity of the cup washer may be lowered. Therefore, the cup washer provided in a tower shape with a relatively larger length in the vertical direction may maintain a stable state without easily tipping over even in the event of an external impact.

The washing unit 130 may be disposed above the water tank 120 and wash the accommodated cup. A space for accommodating a cup may be formed in the washing unit 130. The washing unit 130 may be connected to the water tank 120 with a pipe. Therefore, water for washing may flow into the washing unit 130 from the water tank 120.

In another embodiment, the washing unit 130 may be directly connected to the city water supply bypassing the water tank 120. Therefore, depending on selection, the cup may be washed using water introduced from the water tank 120 or the cup may be washed using water introduced directly from the city water supply.

The intermediate plate 140 may be disposed between the water tank 120 and the washing unit 130 to support the washing unit 130. The washing unit 130 may be disposed above the intermediate plate 140, and the intermediate plate 140 may support a portion of the load of the washing unit 130. The intermediate plate 140 may have a substantially plate-like shape and may be coupled to the frame 160 at an edge thereof to be supported by the frame 160.

The door 150 may be disposed above the washing unit 130 and hinge-rotated in the vertical direction to open and close an open upper portion of the washing unit 130. Referring to FIG. 3, the door 150 may be hinge-rotated in the vertical direction of the cup washer. Therefore, a user may proceed with washing a cup 10 by manually opening the door 150 to put the cup 10 into the washing unit 130 and re-closing the door 150.

A top cover 210 may be provided at an upper end of the washing unit 130. A portion of the top cover 210 may be coupled to an edge portion of the upper end of the washing unit 130, and the door 150 may be disposed thereon.

An inlet cover 213 may be provided on the other part of the top cover 210. The inlet cover 213 may open and close inlets for detergent and rinse put into the washing unit 130 and may be detachably provided on the top cover 210.

A user may open or close the door 150 disposed on the upper end of the cup washer to put a cup into the washing unit 130 or take the cup out of the washing unit 130. At this time, since the door 150 is hinge-rotated in the vertical direction, the user may conveniently move the door 150 without bending down.

In addition, due to the hinge-rotation of the door 150, the door 150 may be provided so that an area of the cup washer is not changed in a plan view even in a state in which the door 150 is open. Therefore, since a planar cross-sectional area of the cup washer is constant regardless of whether the door 150 is opened or closed, no additional space is required to open the door 150.

In the embodiment, since the cup may be provided to hinge-rotate in the vertical direction of the cup washer at the upper end of the washing unit 130, the user may conveniently use the cup washer by opening or closing the door 150 without bending down. In addition, with this structure, since no additional space for opening the door 150 is required, it is possible to increase space efficiency.

The frame 160 may be supported by the base plate 110 and coupled to the intermediate plate 140 and support the washing unit 130. The frame 160 may provide an internal space of the cup washer and may be coupled to various components to support these components.

The frame 160 may include the front support 161, the rear support 162, the intermediate support 163, and an upper support 164. The components of the frame 160 may support loads of the washing unit 130, the door 150, and the like provided on the upper portion of the cup washer.

A pair of front supports 161 may be disposed to be spaced apart from each other on a front portion of the cup washer and have lower portions coupled to the base plate 110, and longitudinal directions thereof are disposed in the vertical direction. The pair of front supports 161 may be disposed at positions of the front portion of the cup washer, which are spaced apart from each other in a lateral direction of the cup washer and may form corner portions of the front portion of the cup washer.

The front supports 161 may be formed in an L-shaped cross section to form the corner portions of the cup washer. The front supports 161 may be coupled to the base plate 110 by couplers such as a screw.

A pair of rear supports 162 may be disposed to be spaced apart from each other on a rear portion of the cup washer and have lower portions coupled to the base plate 110, and longitudinal directions thereof are disposed in the vertical direction. The pair of rear supports 162 may be disposed at positions of the rear portion of the cup washer, which are spaced apart from each other in the lateral direction of the cup washer and disposed adjacent to corner portions of the rear portion of the cup washer. The rear supports 162 may be coupled to the base plate 110 by couplers.

A pair of intermediate supports 163 may be disposed to be paced apart from each, may be disposed between the front supports 161 and the rear supports 162, and may have lower portions coupled to the base plate 110, and longitudinal directions thereof are disposed in the vertical direction. The pair of intermediate supports 163 may be disposed at positions of a central portion of the cup washer, which are spaced apart from each other in the lateral direction of the cup washer.

The intermediate supports 163 may be coupled to the base plate 110 by couplers. In addition, the intermediate supports 163 may be coupled to the intermediate plates 140 and the upper supports 164 by the couplers to stably maintain the positions and support the loads of the components of the cup washer.

The upper supports 164 may be disposed above the intermediate supports 163, the pair of upper supports 164 may be disposed to be spaced apart from each other in the lateral direction, and longitudinal directions thereof are disposed in a front-rear direction, and the washing unit 130 may be coupled to the pair of upper supports 164. The pair of upper supports 164 may be disposed at positions of the upper portion of the cup washer, which are spaced apart from each other in the lateral direction of the cup washer.

The washing unit 130 may be connected to the upper supports 164 by couplers. Therefore, the upper supports 164 may support the load of the washing unit 130.

A plurality of upper supports 164 may be provided to be spaced apart from each other in the vertical direction of the cup washer. Therefore, in FIG. 5 and the like, an embodiment in which a total of four upper supports including one pair provided at both sides of the cup washer, and one pair provided on the upper and lower portions of the cup washer are provided is illustrated. However, the number of upper supports 164 is not limited thereto.

Each of the upper supports 164 may be coupled to the front support 161, the rear support 162, and the intermediate support 163. Therefore, the load of the washing unit 130 may be transmitted to the front support 161, the rear support 162, and the intermediate support 163 through the upper support 164 and ultimately transmitted to the base plate 110.

With this structure, the cup washer may stably support the washing unit 130 provided therein. The upper support 164 may be coupled to the front support 161, the rear support 162, and the intermediate support 163 by couplers such as a screw.

In the embodiment, components provided on the upper portion of the cup washer in addition to the washing unit 130 may be supported by the frame 160, and the components may be ultimately supported by the base plate 110. With this structure, the components may be stably supported by the frame 160 and the base plate 110 even in a state in which relatively heavier components such as the washing unit 130 are provided on the upper portion of the cup washer.

The cup washer may include a front panel 170 and a rear panel 180. The front panel 170 may be disposed on the front portion of the cup washer to cover the water tank 120 and the washing unit 130. The front panel 170 may be coupled to the rear support 162 of the frame 160 by a coupler.

The rear panel 180 may be coupled to the frame 160 to cover the rear portion of the cup washer. A first vent 181 for ventilating an inside and an outside of the cup washer may be provided on the rear panel 180. Air flowing into a drying module 132 to be described below may flow into the cup washer through the first vent 181.

A handle 260 for a user or a manager to hold the cup washer may be coupled to the rear panel 180 to facilitate the movement of the cup washer.

The cup washer may include a display unit 190 coupled to an upper portion of the rear support 162 and disposed at one side of the door 150. The display unit 190 may be disposed at the one side of the door 150 and provided to protrude from the door 150.

Therefore, the user may look at the display unit 190 in front of the cup washer. Various pieces of information on the use of the cup washer may be displayed on the display unit 190 in a form of images, texts, and videos.

The user may operate the cup washer or know an operating state of the cup washer by looking at the information displayed on the display unit 190. In addition, an instruction input device in which instructions are inputted by, for example, a capacitive touch method may be provided on the display unit 190. Therefore, the user may control the operation of the cup washer using the display unit 190.

The cup washer may include a first circuit board 220 and a board support 230. The first circuit board 220 may be disposed at one side of the water tank 120 and may include a controller for controlling the operation of the cup washer. The first circuit board unit 220 may be disposed at one side of the water tank 120 positioned on the lower portion of the cup washer (in which an extra space is formed due to the arrangement of the water storage path having a relatively smaller volume than the washer unit 130).

The hoard support 230 may have a lower portion coupled to the base plate 110, an upper portion coupled to the intermediate plate 140, and may be coupled to the first circuit board 220. The board support 230 may be stably coupled to the base plate 110 by a coupler.

The board support 230 may be used not only to fix the first circuit board 220, but also to fix a pipe disposed on the lower portion of the cup washer.

The cup washer may include an exterior unit 250 coupled to the rear panel 180 to cover the rear support 162. A plurality of fasteners may be coupled to the rear support 162 for coupling with other components of the cup washer.

Therefore, a structure in which the rear support 162 to which the fastener is fastened is directly exposed to the outside may degrade a visual sense of beauty of the cup washer. Therefore, a structure of covering the rear support 162 to which the fastener is fastened is required.

The exterior unit 250 may cover the rear support 162 and may be coupled to a relatively very fewer number of fasteners compared to the rear support 162. With this structure, the exterior unit 250 may be disposed outside the cup washer at a position corresponding to the rear support 162 to make the cup washer entirely look simple.

Figure 6:
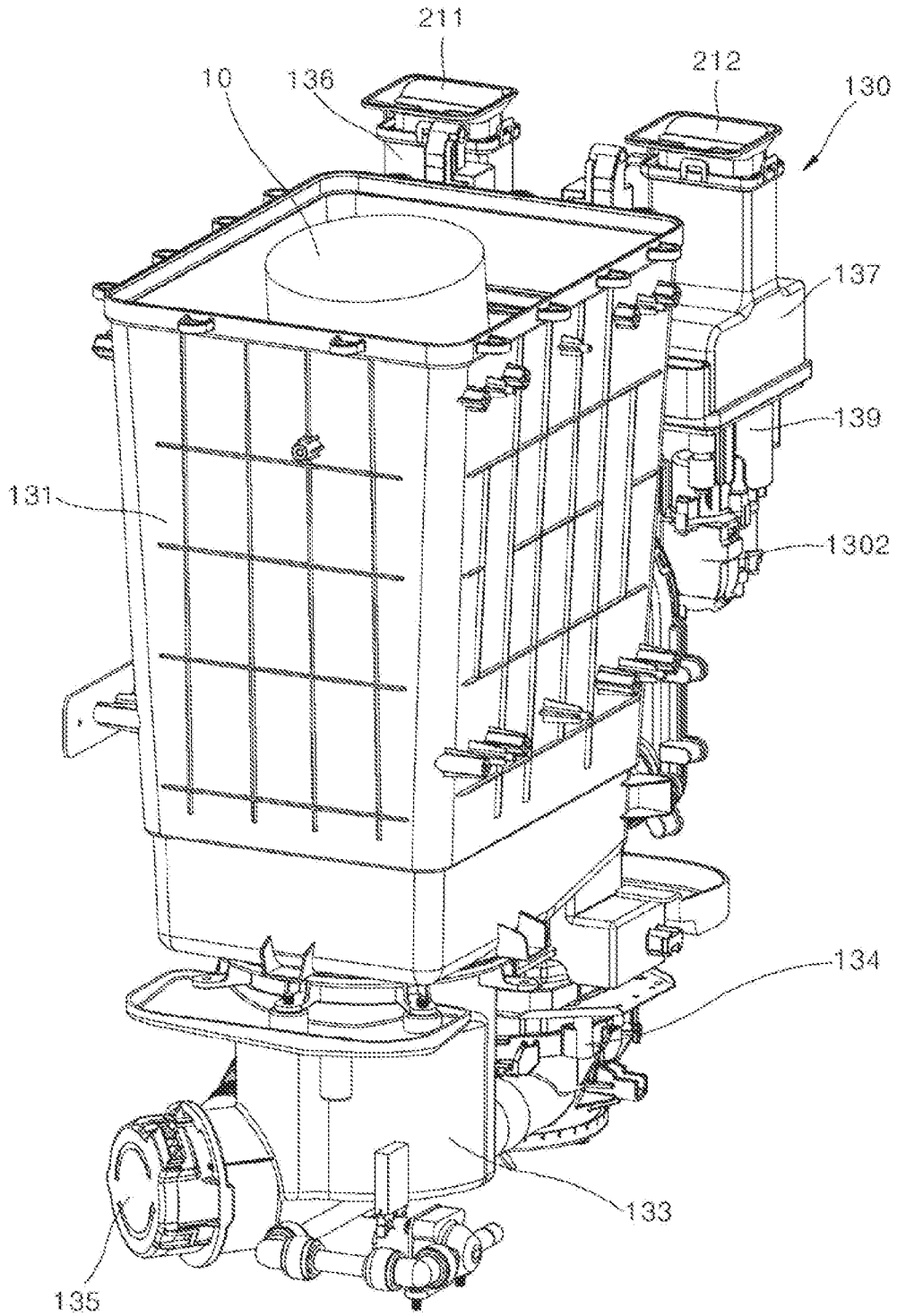
FIG. 6 is a perspective view illustrating a washing unit according to one embodiment.
Figure 7:
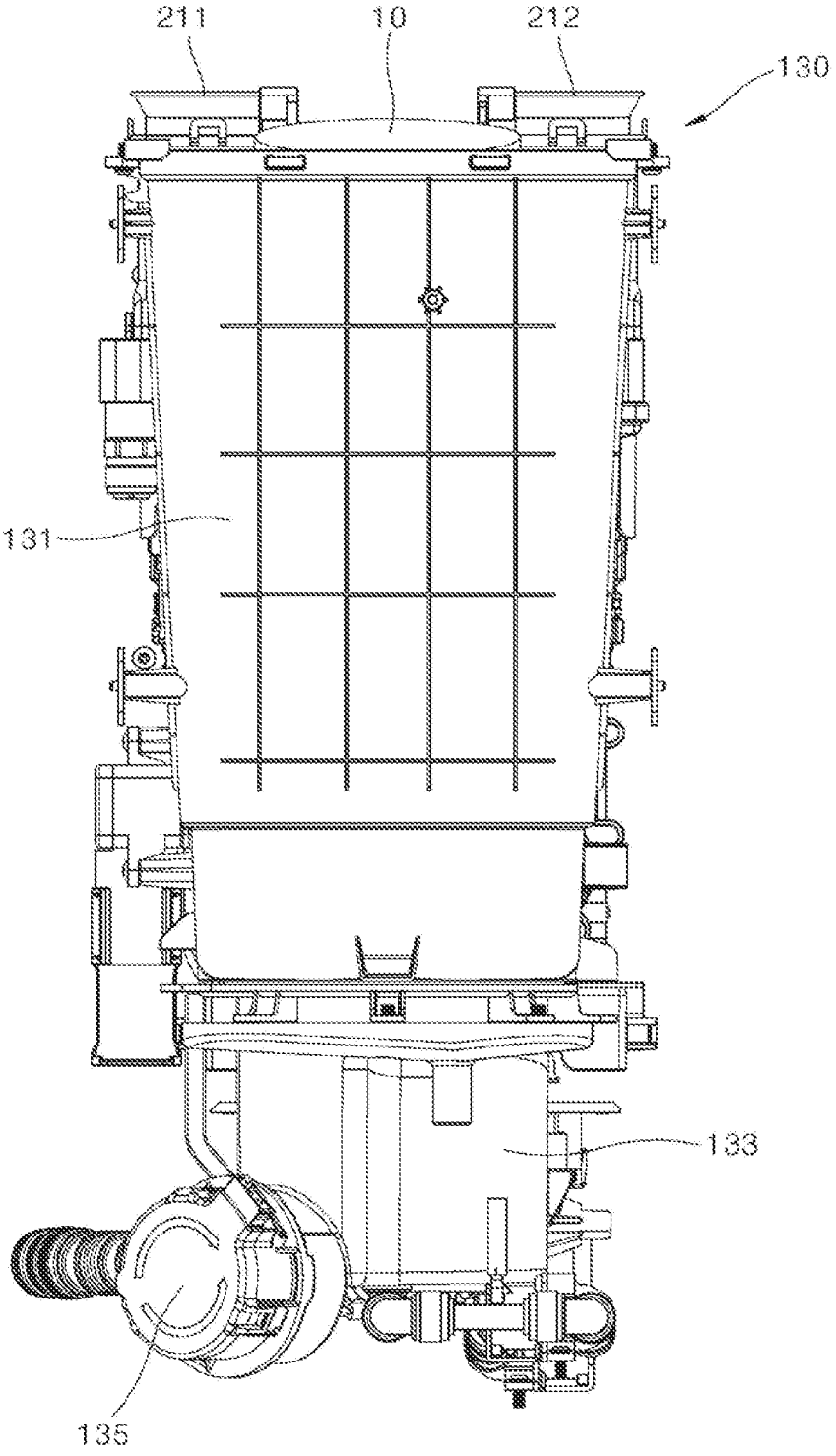
FIG. 7 is a front view illustrating the washing unit according to one embodiment.
Figure 8:
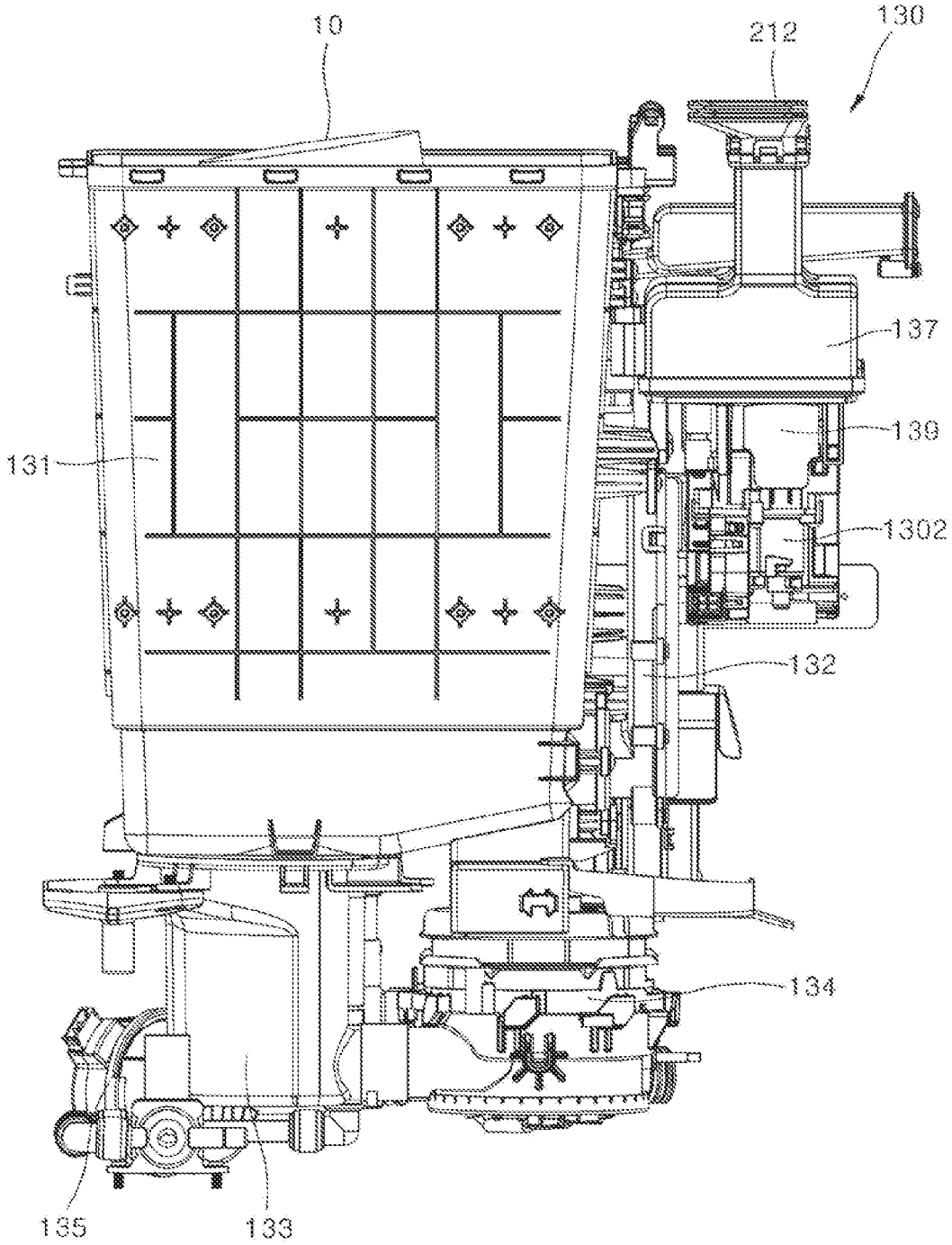
FIG. 8 is a side view illustrating the washing unit according to one embodiment.
Figure 9:
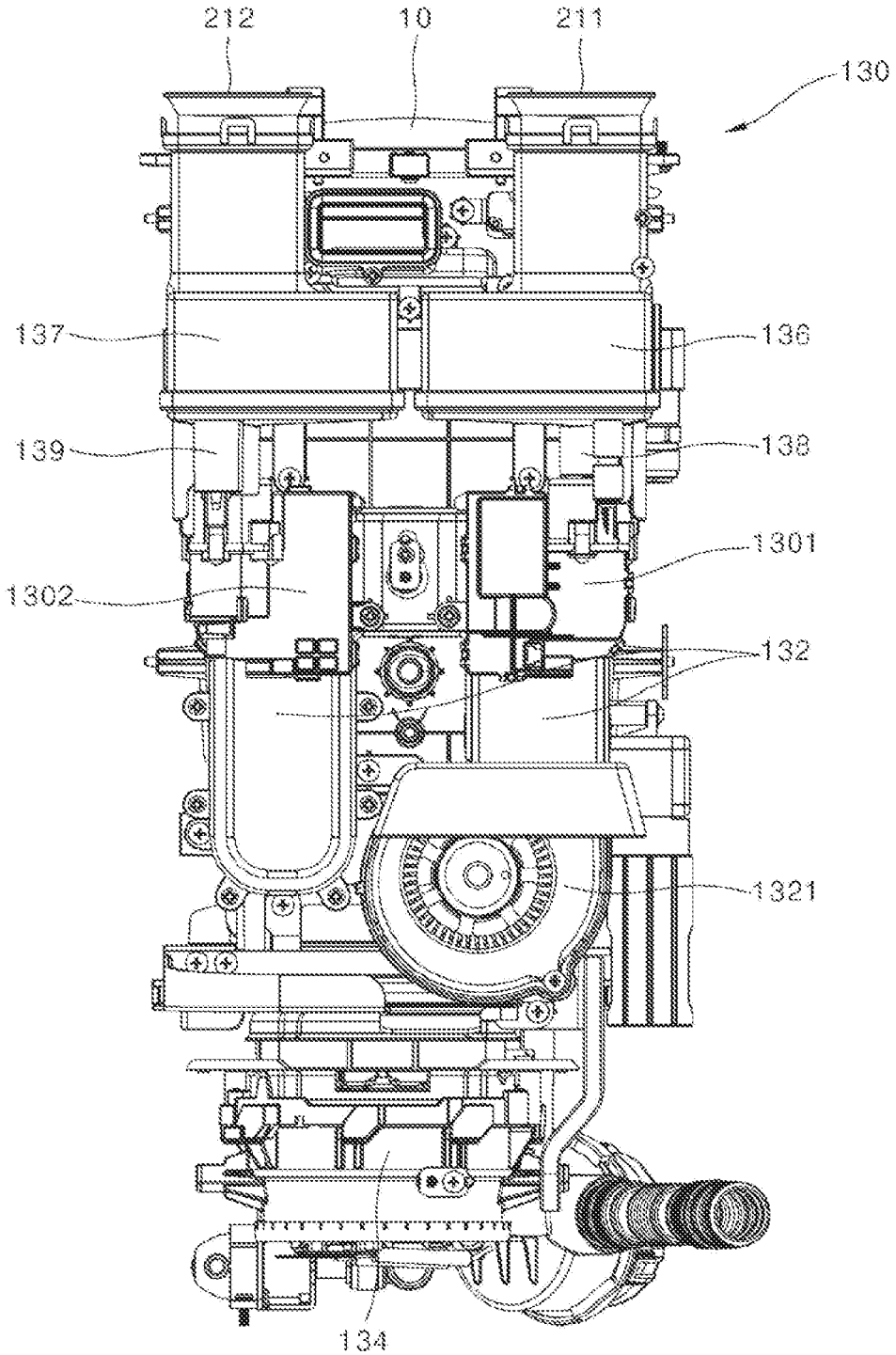
FIG. 9 is a rear view illustrating the washing unit according to one embodiment.

Hereinafter, a specific structure of the washing unit 130 will be described in detail with reference to the drawings. FIG. 6 is a perspective view illustrating the washing unit 130 according to one embodiment. FIG. 7 is a front view illustrating the washing unit 130 according to one embodiment. FIG. 8 is a side view illustrating the washing unit 130 according to one embodiment. FIG. 9 is a rear view illustrating the washing unit 130 according to one embodiment.

The washing unit 130 may include the tub 131, the drying module 132, a sump 133, a circulation pump 134, and a drain pump 135.

The tub 131 may provide a space in which a cup is accommodated, and washing water is sprayed to the tub 131. A rack on which a cup is mounted may be provided inside the tub 131, and a spray device for spraying water may be provided on a lower portion of the tub 131. An open upper end of the tub 131 may be opened and closed by the door 150.

The drying module 132 may be disposed at one side of the tub 131 to be connected to the tub 131 and spray heated air for drying into the tub 131. After the washing of the cup 10 with water is completed, water remains on surfaces of the cup. The drying module 132 may dry the cup by spraying the heated air, that is, hot air to the cup to dry the cup with the remained water.

A heating device for heating air flowing into the drying module 132 may be provided in the drying module 132. In addition, a blowing fan 1321 for forcing air to flow through a flow path formed in the drying module 132 may be provided in the drying module 132.

The sump 133 may be disposed under the tub 131 to be connected to the tub 131 and store the water sprayed from the tub 131. The water stored in the sump 133 may be sprayed by the spray device from the tub 131 while circulating in the tub 131 and the sump 133 by the circulation pump 134 to wash the cup 10 accommodated in the tub 131.

The circulation pump 134 may be disposed under the tub 131 to be connected to the tub 131 and the sump 133 and circulate water between the tub 131 and the sump 133. The circulation pump 134 may force water to flow from the sump 133 to the tub 131.

The circulation pump 134 may be connected to the spray device disposed on the lower portion of the tub 131. Therefore, when the circulation pump 134 operates, the water stored in the sump 133 may flow into the spray device and may be sprayed into the tub 131 by the spray device to wash the cup.

The drain pump 135 may be disposed under the tub 131 to be connected to the sump 133 and discharge water from the sump 133 to the outside. When the washing of the cup with water is completed, the drain pump 135 may operate so that the water stored in the sump 133 may be discharged to the outside of the cup washer through a drain pipe connected to the drain pump 135.

A washing process of the cup 10 with the water stored in the water tank 120 is as follows. Water may flow into the water tank 120 from the city water supply through a pipe and may be stored therein. The water in the water tank 120 may be heated by the heating device provided in the water tank 120. Heated water in the water tank 120 may flow into the tub 131 through a pipe and may be stored in the sump 133 disposed under the tub 131.

When the circulation pump 134 is operated to wash the cup, hot water may be sprayed from the sump 133 into the tub 131 through the spray device to wash the cup. The hot water sprayed to the tub 131 may flow back to the sump 133, flow back to the spray device by the circulation pump 134, and may be sprayed into the tub 131 by the spray device.

While the circulation pump 134 is operating, water for washing may sequentially flow through the sump 133, the spray device, and the tub 131, and this flow may be repeated. When the washing of the cup with water is completed, the circulation pump 134 may be stopped, and the drain pump 135 may be operated to discharge the water stored in the sump 133 to the outside.

When the drainage by the drain pump 135 is completed, the drying module 132 may be operated to spray hot air into the tub 131, and after the spraying of the hot air is performed for a set time, a cup washing operation including a drying process may be completed.

The cup washer may perform washing using detergent and then rinsing using rinse. Hereinafter, a structure provided to input the detergent and the rinse into the tub 131 will be described in detail.

Meanwhile, in the cup washing process with water, the washing process using detergent and the rinsing process using rinse may be separated. After a process of washing the cup by mixing detergent with water is completed, the water in the sump 133 contains detergent and foreign substances. Therefore, the contaminated water may be discharged to the outside by operating the drain pump 135.

After the contaminated water is discharged to the outside, the rinsing operation may be performed by allowing water to flow back to the sump 133, mixing the water with the rinse and operating the circulation pump 134. It is possible to increase washing efficiency of the cup washer by separating the washing process using the detergent and the rinsing process using the rinse by such a method.

The washing unit 130 may include a detergent storage 136, a rinse storage 137, a detergent injection part 138, a rinse injection part 139, a detergent pump 1301, and a rinse pump 1302.

The detergent storage 136 may be disposed behind the tub 131 to store detergent. The rinse storage 137 may be disposed behind the tub 131 separately from the detergent storage 136 to store rinse. Therefore, the detergent and the rinse may not be mixed.

A detergent inlet 211 into which the detergent is input and a rinse inlet 212 into which the rinse is input may be provided on the top cover 210. The detergent inlet 211 may be connected to the detergent storage 136, and the rinse inlet 212 may be connected to the rinse storage 137. Therefore, the detergent and the rinse introduced through the detergent inlet 211 and the rinse inlet 212 may be stored in the detergent storage 136 and the rinse storage 137.

The detergent injection part 138 may be connected to the detergent storage 136 and the tub 131 to inject the detergent into the tub 131. An inlet of the detergent injection part 138 may be connected to the detergent storage 136 and an outlet thereof may be connected to the tub 131.

The rinse injection part 139 may be connected to the rinse storage 137 and the tub 131 to inject the rinse into the tub 131. An inlet of the rinse injection part 139 may be connected to the rinse storage 137 and an outlet thereof may be connected to the tub 131.

The detergent pump 1301 may be connected to the detergent injection part 138 to pump the detergent to the tub 131. The rinse pump 1302 may be connected to the rinse injection part 139 to pump the rinse to the tub 131. Operations of the detergent pump 1301 and the rinse pump 1302 may be controlled by the controller.

The controller may operate the detergent pump 1301 to mix the detergent with water in the washing process and operate the rinse pump 1302 to mix the rinse with water in the rinsing process.

The water tank 120 may be connected to the tub 131 using a pipe and provided so that the water in the water tank 120 flows into the tub 131. Therefore, the water in the water tank 120 may directly flow into the tub 131 at room temperature or after being heated to become hot water and may be stored in the sump 133 until the circulation pump 134 operates. Meanwhile, as described above, the tub 131 may also have a water supply path directly connected to the city water supply.

Normal washing or rapid washing of the cup may be performed according to the user's selection. In the normal washing, the cup may be washed using the water in the water tank 120, and the cup may be cleanly washed using detergent and rinse, but it may take a relatively longer time.

Since detergent and rinse are not used in the rapid washing, a washing time is relatively short, and thus a user who wants to quickly wash a cup that is relatively less contaminated may conveniently use the cup washer.

Figure 10:
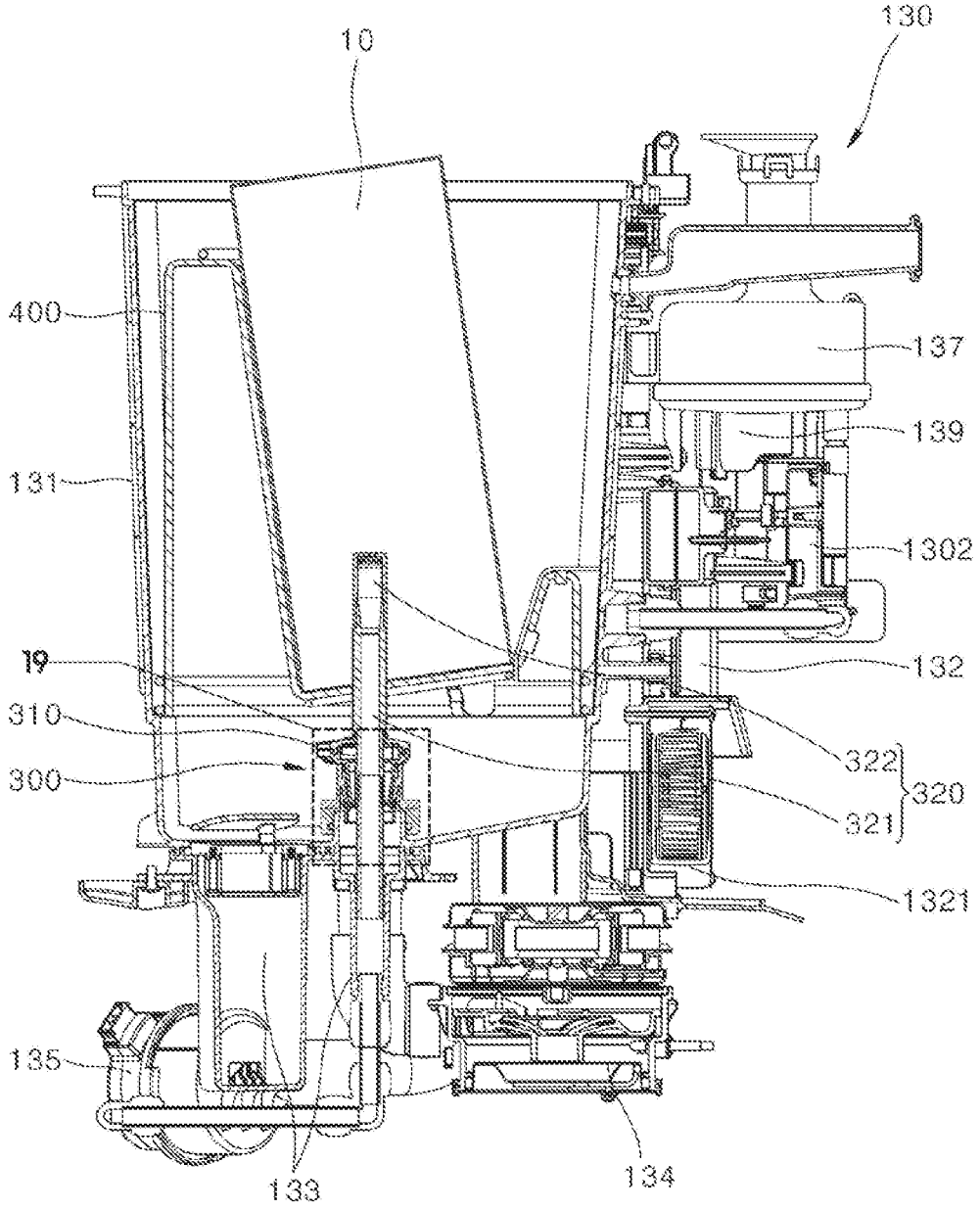
FIG. 10 is a cross-sectional view illustrating the washing unit according to one embodiment.
Figure 11A:
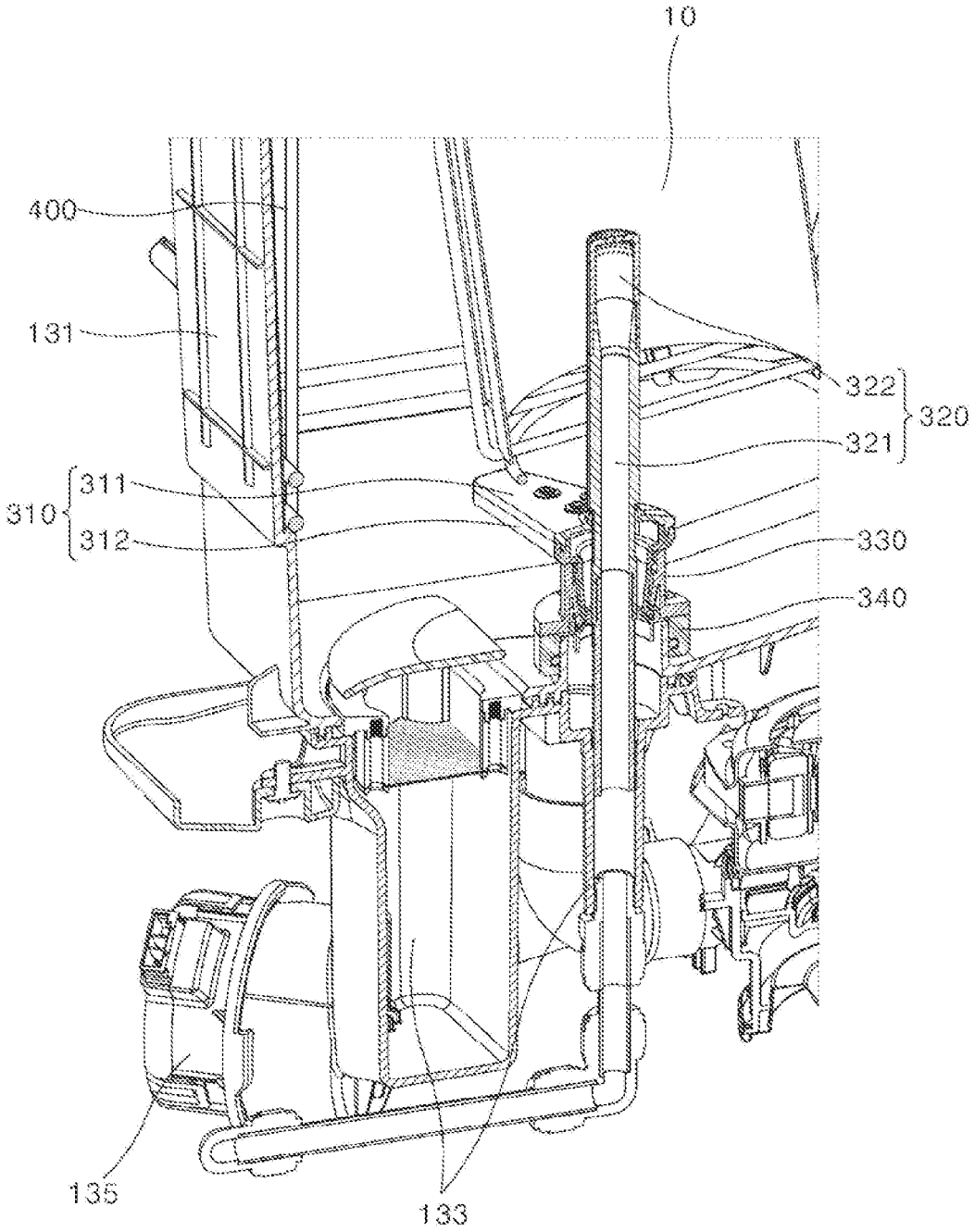
FIG. 11A is an enlarged cross-sectional view illustrating a portion of FIG. 10.
Figure 11B:
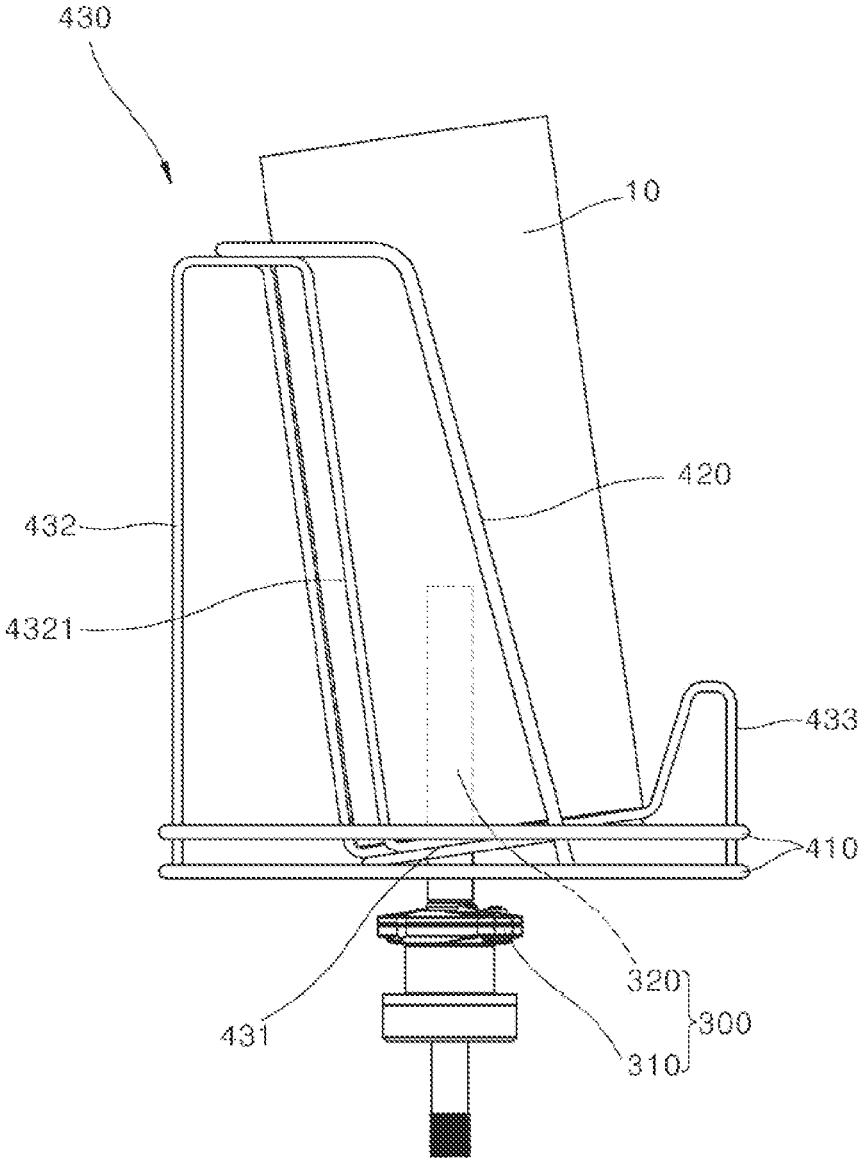
FIG. 11B is a side view illustrating a rack according to one embodiment.
Figure 11C:
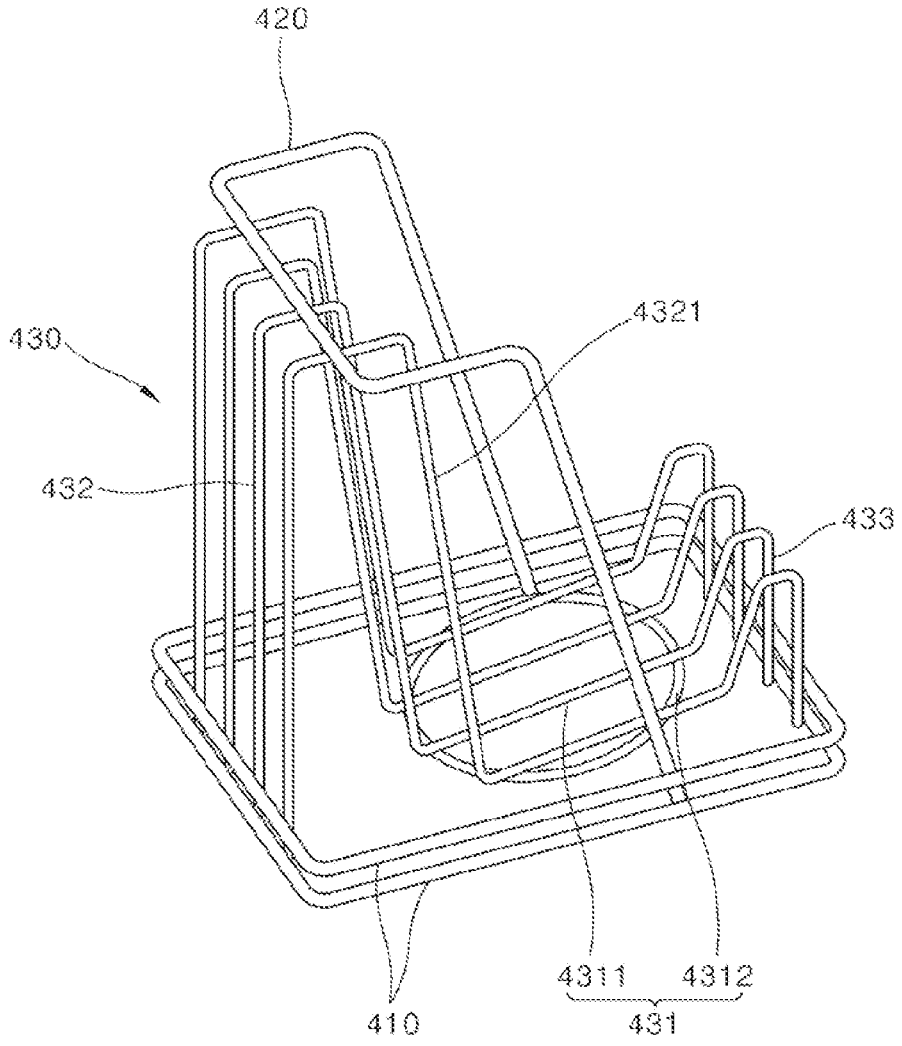
FIG. 11C is a perspective view illustrating the rack according to one embodiment.

FIG. 10 is a cross-sectional view illustrating the washing unit 130 according to one embodiment. FIG. 11A is an enlarged cross-sectional view illustrating a portion of FIG. 10. FIG. 11B is a side view illustrating a rack 400 according to one embodiment. FIG. 11C is a perspective view illustrating the rack 400 according to one embodiment.

The washing unit 130 may include a spray unit 300 for spraying water. The spray unit 300 may be disposed on the tub 131 and coupled to the sump 133 to spray water toward the cup 10.

The sump 133 may include a portion in which a space for storing water is formed and a portion on which the spray unit 300 is mounted and to which a pipe connected to the city water supply is coupled.

The spray unit 300 may include a first spray nozzle 310 and a second spray nozzle 320. The first spray nozzle 310 may be provided to be rotated, and the second spray nozzle 320 may be provided to be fixed not to be rotated. The first spray nozzle 310 may be rotatably mounted on the washing unit 130 to spray water into the tub 131 and the cup accommodated in the tub 131 while being rotated by water pressure without a separate device such as a motor.

The second spray nozzle 320 may extend in the vertical direction of the tub 131 and include at least one spray hole. The first spray nozzle 310 may extend from an outer circumference of the second spray nozzle 320 toward both side surfaces of the tub, may include at least one spray hole, and may be provided to rotate around the second spray nozzle 320.

The first spray nozzle 310 may have a generally flat exterior, and a space in which water flows may be formed in the first spray nozzle 310. The second spray nozzle 320 may be coupled to a central portion of the first spray nozzle 310. Therefore, in order to secure a space to which the second spray nozzle 320 is coupled, the first spray nozzle 310 may be provided in a shape in which a cross-sectional area is relatively wide at the central portion and the cross-sectional area decreases toward an end thereof.

A first spray hole 3111 (See FIG. 12) through which washing water is sprayed may be formed in an upper surface of the first spray nozzle 310, and a plurality of first spray holes 3111 may be provided. Therefore, in order to secure an area in which the plurality of first spray holes 3111 are formed, the entirety of the first spray nozzle 310 may be formed in a flat shape with an upper surface wider than a side surface.

The second spray nozzle 320 may be provided in a form extending relatively long in the vertical direction, the plurality of spray holes through which water for washing is sprayed may be formed to form a region in the longitudinal direction, and a space in which water flows may be formed in the second spray nozzle 320. The second spray nozzle 320 may have a cylindrical exterior. In another embodiment, the second spray nozzle 320 may also be formed to have a polygonal column-shaped exterior.

Water at room temperature or heated water may flow in the first spray nozzle 310 and the second spray nozzle 320 and may be sprayed to the tub 131. The first spray nozzle 310 may be provided to extend to the outer circumference of the second spray nozzle 320. The first spray nozzle 310 may be provided to rotate, and a longitudinal direction thereof is disposed in the lateral direction of the tub 131. The first spray nozzle 310 may spray water when the cup washer operates in the normal washing mode.

The second spray nozzle 320 may be coupled to the first spray nozzle 310, disposed on the central portion of the first spray nozzle 310, and provided to protrude upward from the first spray nozzle 310. The second spray nozzle 320 may be fixedly coupled to the sump 133 so as not to be rotated.

The second spray nozzle 320 may be directly connected to the city water supply and when the cup washer operates in the rapid washing mode, may spray tap water introduced from the city water supply to the cup 10 to wash the cup. In another embodiment, the second spray nozzle 320 may be connected to the water tank 120 using a pipe to receive water from the water tank 120.

In the embodiment, the spray unit 300 may include the first spray nozzle 310 for spraying water to the cup while rotating and the second spray nozzle 320 that does not rotate but is disposed adjacent to an inner surface of the cup. Therefore, it is possible to effectively wash the inner surface and an outer surface of the cup using the first spray nozzle 310 and the second spray nozzle 320.

Figure 12:
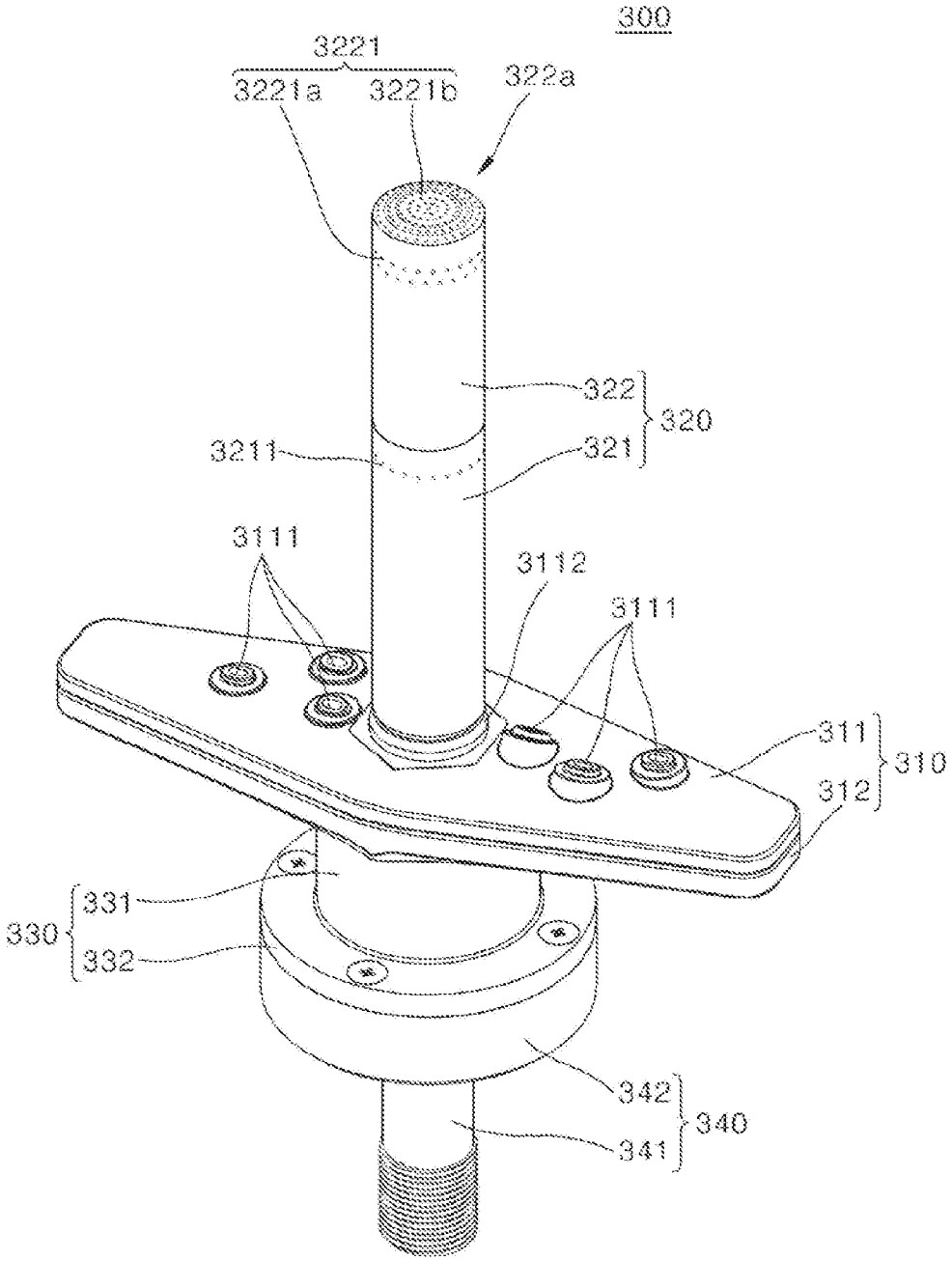
FIG. 12 is a perspective view illustrating a spray unit according to one embodiment.
Figure 13:
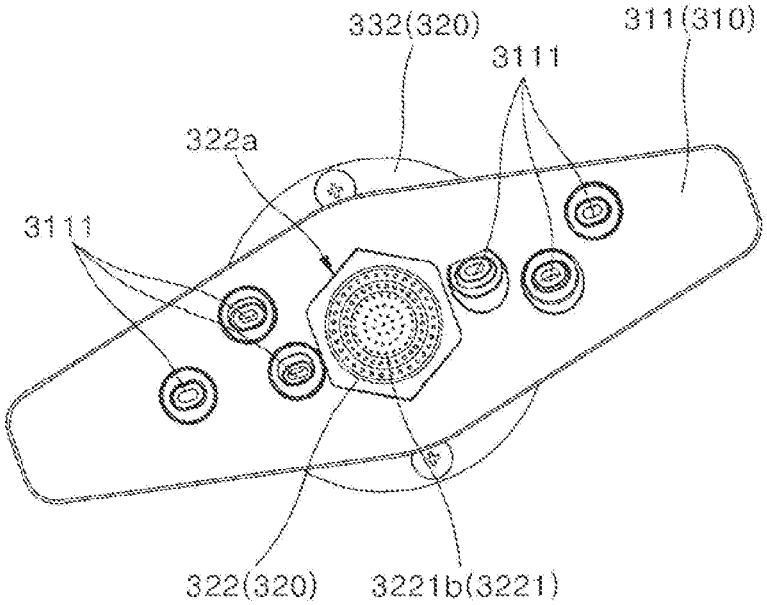
FIG. 13 is a plan view illustrating the spray unit according to one embodiment.
Figure 14:
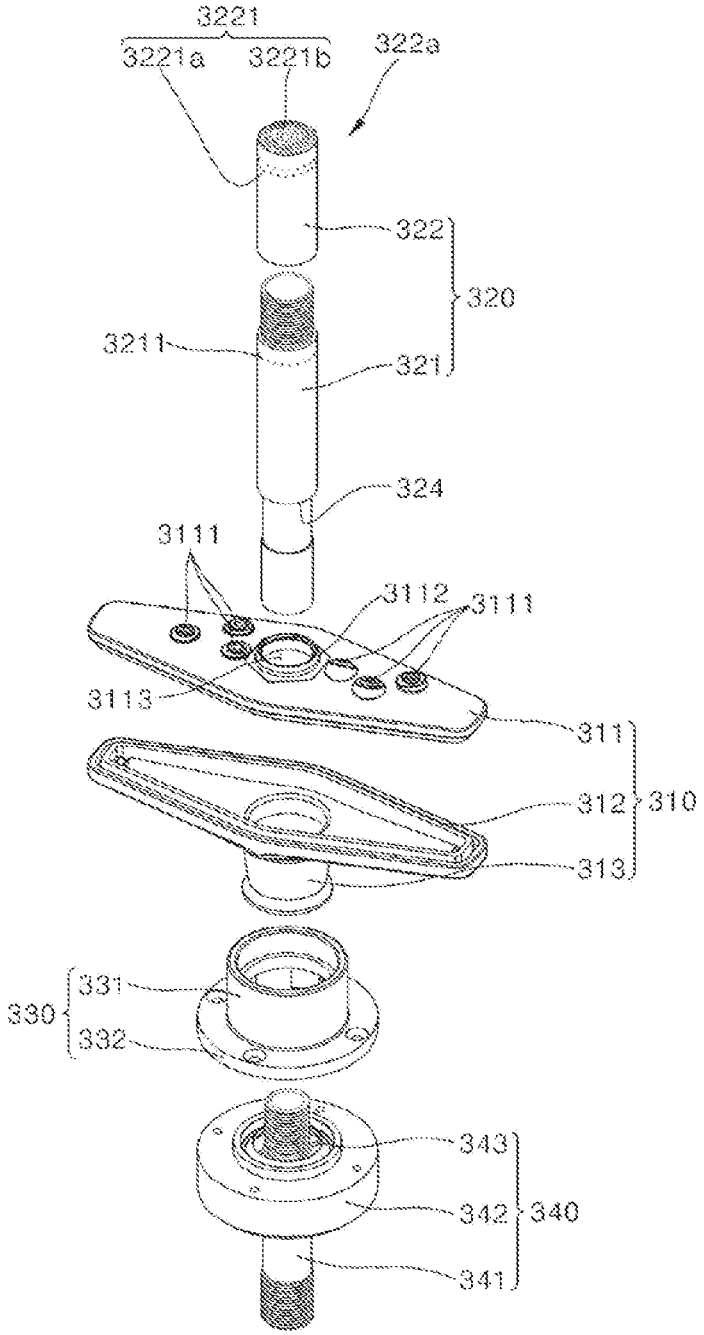
FIG. 14 is an exploded view illustrating the spray unit according to one embodiment.
Figure 15:
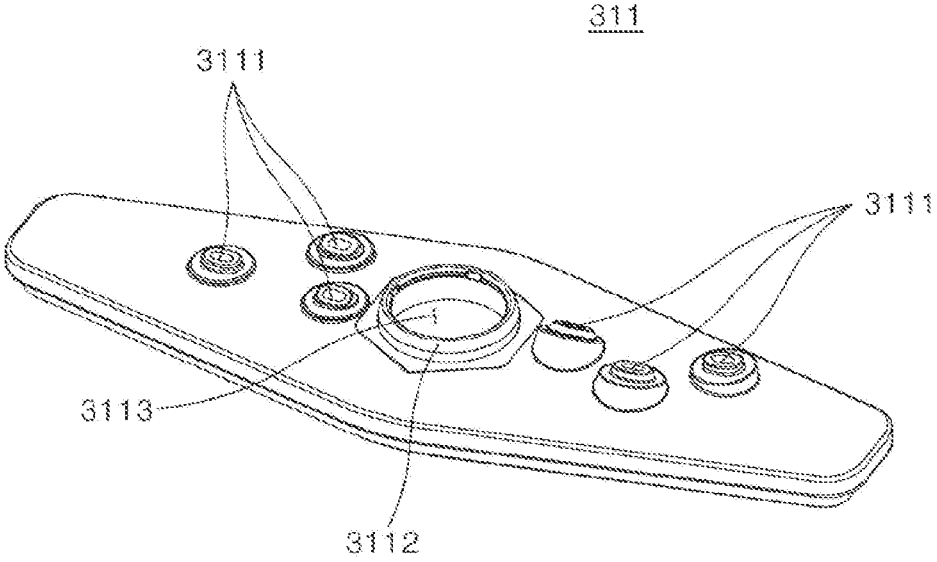
FIG. 15 is a perspective view illustrating a first piece according to one embodiment.
Figure 16A:
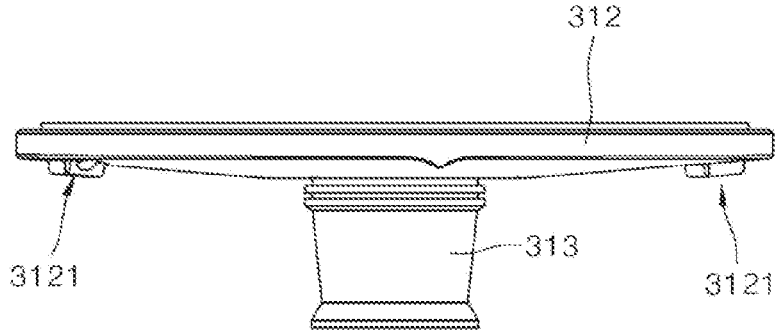
FIG. 16A is a side view illustrating the spray unit of FIG. 12.
Figure 16B:
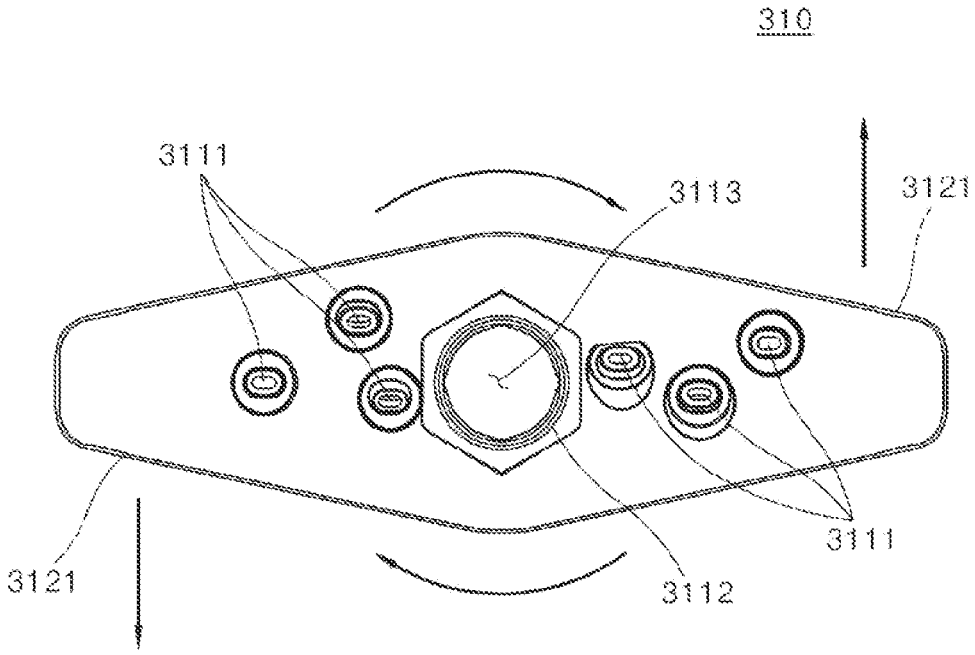
FIG. 16B is a plan view illustrating a first spray nozzle according to one embodiment.

FIG. 12 is a perspective view illustrating the spray unit 300 according to one embodiment. FIG. 13 is a plan view illustrating the spray unit 300 according to one embodiment. FIG. 14 is an exploded view illustrating the spray unit 300 according to one embodiment. FIG. 15 is a perspective view illustrating a first piece 311 according to one embodiment. FIG. 16A is a side view illustrating the spray unit of FIG. 12. FIG. 16B is a plan view illustrating the first spray nozzle 310 according to one embodiment.

Washing may be performed in a state in which the cup is disposed upside down in the tub 131. That is, an open portion of the cup may be disposed to face the lower portion of the tub 131, and thus the water sprayed from the first spray nozzle 310 and the second spray nozzle 320 may be directed to the inside of the cup.

Since the longitudinal direction of the first spray nozzle 310 is disposed in the lateral direction of the tub 131, the water may be sprayed to the entire inside of the tub 131, and thus both the inner surface and the outer surface of the cup accommodated in the tub 131 can be washed.

When the cup is disposed on the tub 131, the second spray nozzle 320 may be mostly positioned inside the cup. Therefore, the second spray nozzle 320 may quickly complete cup washing by mainly washing the inner surface of the cup in the rapid washing mode.

The first spray nozzle 310 may include the first spray holes 3111 and second spray holes 3121. The first spray holes 3111 may be formed in the upper surface of the first spray nozzle 310 and disposed to be spaced apart from each other at positions outward from a rotation center of the first spray nozzle 310, and a plurality of first spray holes 3111 may be provided.

The first spray holes 3111 may be intensively disposed, for example, in a specific region spaced apart from the rotation center of the first spray nozzle 310. In another embodiment, the first spray holes 3111 may be spaced apart from the rotation center of the first spray nozzle 310 and disposed to be spaced apart from each other at positions in the longitudinal direction of the first spray holes 3111.

The second spray holes 3121 may be formed in a lower surface of the first spray nozzle 310 and disposed to be spaced apart from each other at positions outward from the rotation center thereof, and water discharge directions thereof are disposed in opposite directions based on the rotation center of the first spray nozzle 310.

The second spray holes 3121 may be provided to obtain a thrust required for the first spray nozzle 310 to rotate. That is, water discharged from the second spray holes 3121 may generate the thrust, and thus the first spray nozzle 310 may be rotated.

The first spray nozzle 310 may be, for example, formed by two pieces and coupled to each other to form a space in which water flows therein. Therefore, the first spray nozzle 310 may include two pieces, that is, the first piece 311 and a second piece 312. The first piece 311 may form the upper portion of the first spray nozzle 310. The second piece 312 may form a lower portion of the first spray nozzle 310 and may be coupled to the first piece 311 to form the space in which water flows therein.

The first spray holes 3111 may be formed in the first piece. A plurality of first spray holes 3111 may be formed at positions spaced apart from the rotation center of the first spray nozzle 310 to one side and may also be formed at positions spaced apart from the rotation center of the first spray nozzle 310 to the other side, and the first spray holes 3111 may be symmetrically disposed based on the rotation center of the first spray nozzle 310.

The first spray holes 3111 may be provided so that water discharge directions are inclined with respect to the vertical direction and the lateral direction of the tub 131. The water discharge directions of the plurality of first spray holes 3111 may be provided to be inclined in opposite directions based on the rotation center of the first spray nozzle 310. That is, the first spray holes 3111 disposed at symmetrical positions based on the rotation center of the first spray nozzle 310 may be provided to be inclined in opposite directions.

With this structure, when water is discharged from the first spray holes 3111, the water may be sprayed in directions inclined with respect to the vertical direction and the lateral direction of the tub 131 and spread in the entire space inside the tub 131. Therefore, even when the first spray nozzle 310 has a relatively small size, the water sprayed from the first spray nozzle 310 may be sprayed into the entire inside of the tub 131, and thus even when the cup disposed on the tub 131 is large, may wash both the inner surface and the outer surface of the cup.

In addition, since the water discharge directions of the first spray holes 3111 are provided to be inclined, the water sprayed from the first spray holes 3111 may apply the thrust to the first spray nozzle 310 in an inclined direction, and thus the first spray nozzle 310 may be rotated by water pressure even without a separate device such as a motor.

The second spray holes 3121 may be formed in the second piece 312. In addition, the pair of second spray holes 3121 may have the water discharge directions disposed in opposite directions, that is, in symmetrical directions based on the rotation center of the first spray nozzle 310. In addition, the pair of second spray holes 3121 may have the water discharge directions disposed in a direction parallel to the lateral direction of the tub 131 and perpendicular to the longitudinal direction of the first spray nozzle 310.

That is, referring to FIG. 16A, the water discharge directions of the second spray hole 3121 disposed at a left side of the drawing may be disposed to face the front of a paper, and the water discharge directions of the second spray hole 3121 disposed at a right side of the drawing may be disposed to face the rear of the paper.

In FIG. 16B, straight arrows indicate the water discharge directions from the second spray holes 3121, and curved arrows indicate a rotational direction of the first spray nozzle 310. As illustrated in FIG. 16B, in order for the water discharged from the second spray holes 3121 to generate a rotational force of the first spray nozzle 310, the water discharge directions of the second spray holes 3121 may be disposed in a direction perpendicular to the longitudinal direction of the first spray nozzle 310 and provided to become opposite directions at both end portions of the first spray nozzle 310.

With this structure, the water discharged from the second spray holes 3121 may be sprayed in a direction perpendicular to the longitudinal direction of the first spray nozzle 310 to apply a thrust to the first spray nozzle 310, and thus the first spray nozzle 310 may be rotated by water pressure.

Therefore, the first spray nozzle 310 may be rotated by obtaining a thrust from the water discharged due to the structure in which the water discharge directions of the first spray holes 3111 and the second spray holes 3121 are formed.

The second spray holes 3121 may be disposed outside the first spray holes 3111 radially from the rotation center of the first spray nozzle 310, that is, at a position closer to an end of the first spray nozzle 310 compared to the first spray holes 3111. With this structure, it is possible to further increase the rotational force of the first spray nozzle 310 by the water sprayed from the second spray holes 3121.

The second spray nozzle 320 may extend upward higher than the upper surface of the first spray nozzle 310. Therefore, when the second spray nozzle 320 is formed to extend in the vertical direction and the cup is disposed on the tub, at least a portion of the second spray nozzle 320 may be positioned inside the cup.

The second spray nozzle 320 may be provided in two stages including a first protrusion 321 and a second protrusion 322. The first protrusion 321 may protrude upward from the first spray nozzle 310 and include a plurality of third spray holes 3211 disposed to be spaced apart from each other in a circumferential direction.

The first protrusion 321 may be substantially provided in a hollow rod shape. The first spray nozzle 310 may be rotatably coupled to the first protrusion 321. The first protrusion 321 may be coupled to a second bracket 340 by a screw-coupling method.

Water may flow inside the first protrusion 321, and the water may be sprayed into the tub 131 through the third spray holes 3211 formed in the first protrusion 321. The plurality of third spray holes 3211 may be formed in the first protrusion 321, and the third spray holes 3211 may be disposed to be spaced apart from each other in the circumferential direction of the first protrusion 321.

The second protrusion 322 may be coupled to the first protrusion 321, may protrude upward from the first protrusion 321, and may have a fourth spray hole 3221 formed in an upper end portion thereof. The second protrusion 322 may be coupled to the first protrusion 321 by a screw-coupling method.

The second spray nozzle 320 may wash the inner surface of the cup using water supplied from the city water supply or the water tank 120. Therefore, the second spray nozzle 320 needs to be provided to be disposed at a position adjacent to the inner surface of the cup as much as possible.

Therefore, the second spray nozzle 320 may be provided to extend from the first protrusion 321 and may have the second protrusion 322 for spraying water, and the second protrusion 322 may be provided to be entirely or mostly surrounded by the cup disposed on the tub 131.

The second protrusion 322 may be substantially provided in a hollow rod shape. A screw thread for coupling with the first protrusion 321 may be formed at a lower end portion of the second protrusion 322 and opened. Correspondingly, a screw thread for coupling with the second protrusion 322 may be formed at an upper end portion of the first protrusion 321. An upper cover 322*a* for closing an inside of the second protrusion 322 may be provided on an upper end portion of the second protrusion 322.

The fourth spray hole 3221 may be formed in the second protrusion 322, and water flowing through the second protrusion 322 may be discharged through the fourth spray hole 3221 and sprayed into the tub 131. The fourth spray hole 3221 may include first sub spray holes 3221*a* and second sub spray holes 3221*b*.

The first sub spray holes 3221*a* may be disposed in a sidewall of the second protrusion 322 to be spaced apart from each other in the circumferential direction, and a plurality of first sub spray holes 3221*a* may be provided. In addition, each of the first sub spray holes 3221*a* may be provided in the sidewall of the second protrusion 322 in multiple stages. That is, a plurality of first sub spray holes 3221*a* spaced apart from each other in the longitudinal direction of the second protrusion 322 may be provided.

The second sub spray holes 3221*b* may be formed in the upper cover 322*a* provided at an upper end of the fourth spray hole 3221 and disposed to be spaced apart from each other in a diameter direction and a circumferential direction of the upper cover 322*a*.

Water may be sprayed from the third spray holes 3211 and the first sub spray holes 3221*a* in the lateral direction of the second spray nozzle 320, and water may be sprayed from the second sub spray holes 3221*b* upward of the second spray nozzle 320, and thus the water may be sprayed three-dimensionally from the second spray nozzle 320 to effectively wash the inner surface of the cup.

The washing unit 130 may include the rack 400 provided inside the tub 131 and on which the cup is seated. The rack 400 may be manufactured in a mesh form entirely using a wire to allow water to pass therethrough.

Referring to FIGS. 11B and 11C, the rack 400 may include a first cell 410, a second cell 420, and a third cell 430. The first cell 410 may form a lower outer shape of the rack 400 and may be seated on the tub 131. The first cell 410 may be formed in an approximately quadrangular shape using the wire to be stably seated on the tub 131.

The second cell 420 may have both end portions coupled to the first cell 410, may have portions disposed at both sides of the third cell 430, and may be provided to further protrude in one direction than the third cell 430 when viewed from a side surface of the rack 400. With this structure, the second cell 420 may support the cup so that the cup is not separated from the position at which the cup is disposed on the rack 400.

The third cell 430 may have both end portions coupled to the first cell 410 and may be manufactured to have a shape similar to an exterior by bending the wire of the cell to support the cup. The third cell 430 may have a plurality of wires provided to be disposed at constant distances.

The third cell 430 may include a bottom portion 431, a support portion 432, and a stepped portion 433. The bottom portion 431 may form a bottom of the third cell 430 and support the open portion of the cup when the cup is disposed on the rack 400 upside down. The bottom portion 431 may include a plurality of linear members 4311 disposed to be spaced apart from each other and a circular member 4312 coupled to the linear members 4311 to suppress deformation of the linear members 4311. When the rack 400 is seated on the tub 131 and the cup is disposed on the rack 400, at least a portion of the second spray nozzle may be disposed inside the cup by passing through the bottom portion 431.

The support portion 432 may be formed higher than the stepped portion 433 to support the cup disposed on the rack 400. The support portion 432 may include an inclined member 4321, and the bottom portion 431 may also have an inclination. Therefore, when the cup is disposed on the inclined bottom portion 431, the cup may be in contact with the inclined members 4321 and stably supported by the inclined members 4321.

The stepped portion 433 may be formed at a position spaced apart from the support portion 432 and formed lower than the support portion 432. The stepped portion 433 may suppress the cup disposed on the rack 400 from being separated from the position. Therefore, the cup disposed on the rack 400 may be supported by being surrounded by the second cell 420, the support portion 432, and the stepped portion 433, and thus may be stably disposed at a set position.

When the rack 400 is mounted on the tub 131, the bottom portion 431 and the first spray nozzle 310 may be disposed to be spaced apart from each other at positions in the vertical direction. Therefore, when the cup is disposed on the rack 400, the cup and the upper surface of the first spray nozzle 310 may be spaced apart from each other in the vertical direction. Therefore, the first spray nozzle 310 may rotate smoothly without being interfered with the cup and the rack 400.

The cup may be washed by the water sprayed from the tub 131 in a state of being disposed on the rack 400. At this time, at least a portion of the second spray nozzle 320 may be provided to protrude upward after passing through the bottom portion 431 forming a lower end of the rack 400.

The cup may be disposed upside down on the rack 400. Therefore, an open inlet of the cup may be disposed at the lower end of the rack 400 and a closed bottom surface of the cup may be disposed on an upper portion of the rack 400.

The first spray nozzle may be formed to have a length greater than a maximum diameter of the cup seated on the rack 400. Therefore, when the cup is seated on the rack 400, at least portions of both end portions of the first spray nozzle may be disposed outside the cup.

With this structure, the water sprayed from the first spray nozzle may collide with both the inner surface and the outer surface of the cup, and thus the cup may be washed both internally and externally.

When the second spray nozzle 320 protrudes after passing through the bottom portion 431 of the rack 400, the second spray nozzle 320 may naturally be positioned inside the cup in a state in which the cup is disposed on the rack 400. Therefore, when the cup is seated on the rack 400, at least a portion of the second spray nozzle may be disposed inside the cup.

Therefore, the water sprayed from the third spray holes 3211 and the fourth spray hole 3221 of the second spray nozzle 320 may collide with the inner surface of the cup to effectively wash the inner surface of the cup with foreign substances.

In addition, when the cup is seated on the rack 400, at least some of the plurality of spray holes formed in the second spray nozzle 320 may be positioned inside the cup. When the cup is seated on the rack 400, for example, the first sub spray holes 3221*a* and the second sub spray holes 3221*b* may be provided to be positioned inside the cup. When the cup is disposed on the rack 400, the first sub spray holes 3221*a* and the second sub spray holes 3221*b* formed on the upper portion of the second spray nozzle 320 may be at least positioned inside the cup disposed upside down on the rack 400.

Therefore, all the water sprayed from the fourth spray hole 3221 including the first sub spray holes 3221*a* and the second sub spray holes 3221*b* may collide with the inner surface of the cup, and thus effectively wash the inner surface of the cup with foreign substances.

The spray unit 300 may include a first bracket 330 and the second bracket 340. The first spray nozzle 310 may be rotatably coupled to the first bracket 330. The second bracket 340 may be fixedly coupled to the second spray nozzle 320, the first bracket 330 may be mounted on the second bracket 340, and the second bracket 340 may be coupled to the lower portion of the tub 131 to mount the spray unit 300 on the tub 131.

Meanwhile, the first spray nozzle 310 may include a flow path forming unit 313 formed to protrude downward from a central portion of the second piece 312, provided to surround at least a portion of the first spray nozzle 310 and forming a flow path along which water flows into the first spray nozzle 310. The flow path forming unit 313 may surround at least a portion of the first protrusion 321 of the second spray nozzle 320.

Water may flow into the first spray nozzle 310 through the flow path surrounded by the flow path forming unit 313 and the first protrusion 321 and may be sprayed into the tub 131 through the first spray holes 3111 and the second spray holes 3121. A portion of a first flow path to be described below may be formed to be surrounded by the flow path forming unit 313 and the first protrusion 321.

The first bracket 330 may include a first coupling unit 331 and a second coupling unit 332. The first coupling unit 331 may be formed with a hole into which the flow path forming unit 313 is inserted and may be provided to surround the flow path forming unit 313. The flow path forming unit 313 may be inserted into the first coupling unit 331, and thus the first spray nozzle 310 may rotate around the first bracket 330.

The second coupling unit 332 may be provided in a flange shape by protruding in a radial direction of the first coupling unit 331 and coupled to the second bracket 340. The second coupling unit 332 may be integrally formed with the first coupling unit 331, and the second coupling unit 332 may be fixedly coupled to the second bracket 340 so that the second bracket 340 does not rotate and the first spray nozzle 310 may rotate around the second bracket 340.

As illustrated in FIGS. 10, 11A, and 11B, at least a portion of the second spray nozzle 320 may be disposed inside the cup, and at least a portion of the first spray nozzle 310 may be disposed outside the cup. Therefore, water sprayed from the second spray nozzle 320 may mainly collide with the inner surface of the cup, and the water sprayed from the first spray nozzle 310 may collide with both the inner surface and the outer surface of the cup.

For example, water sprayed from some of the first spray holes 3111 and the second spray holes 3121 provided in the first spray nozzle 310 may collide with the outer surface of the cup to wash the outer surface of the cup. In addition, water injected from some of the first spray holes 3111 and the third spray holes 3211 and the fourth spray hole 3221 provided in the second spray nozzle 320 may collide with the inner surface of the cup to wash the inner surface of the cup.

With this structure, the spray unit 300 according to the embodiment may wash both the inner surface and the outer surface of the cup accommodated in the tub 131. Both the inner surface of the cup containing water and beverages and the outer surface of the cup touched by a user's hand may be exposed to the water sprayed from the first spray nozzle 310 and the second spray nozzle 320, and the water may collide with both the inner surface and the outer surface of the cup. Therefore, the cup washer may entirely and cleanly wash the inner surface and the outer surface of the cup at the same time.

Figure 17:
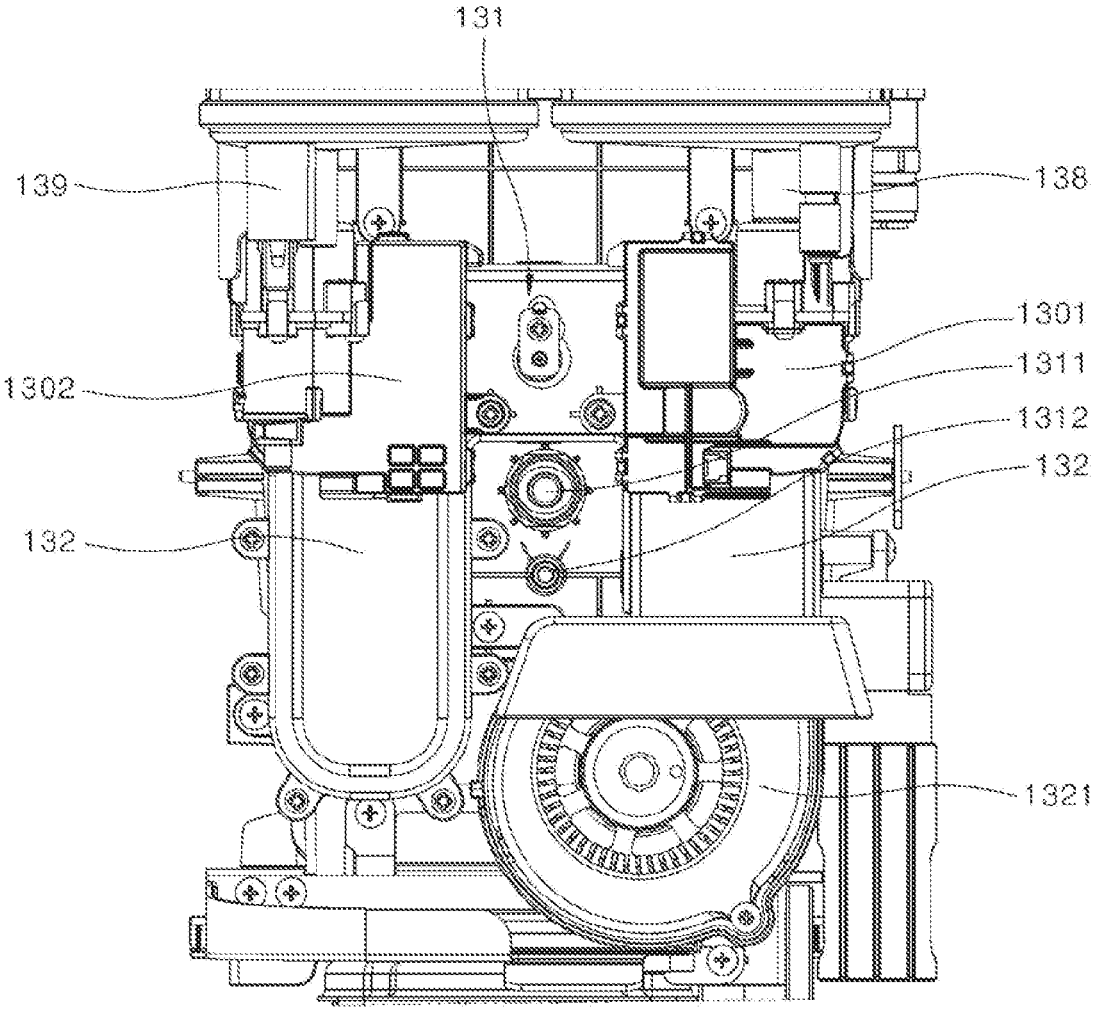
FIG. 17 is an enlarged view illustrating a portion of a front surface of the washing unit.
Figure 18:
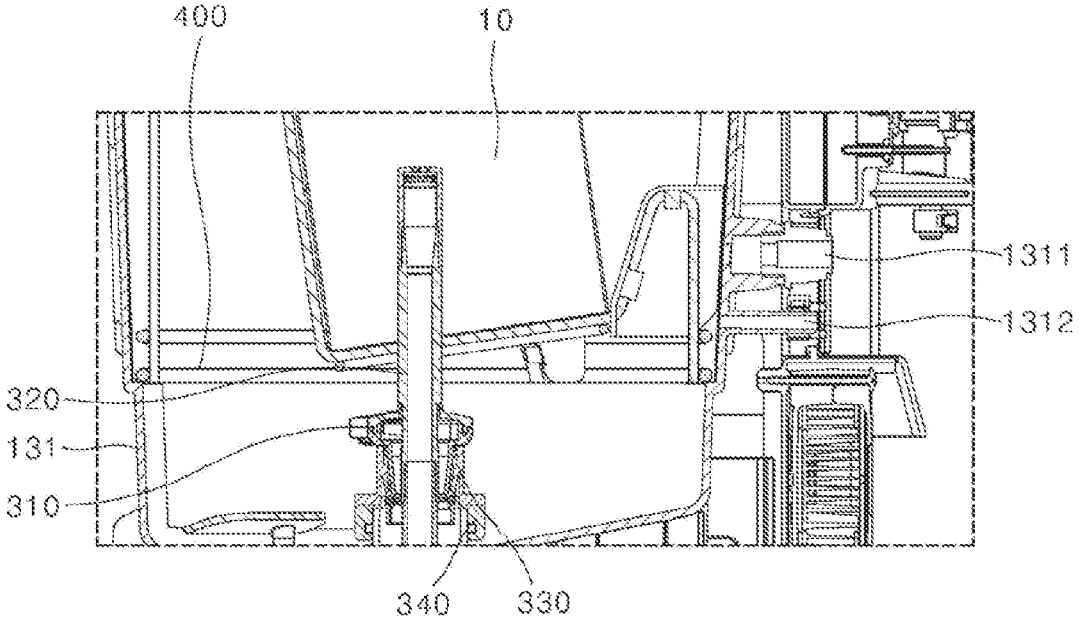
FIG. 18 is an enlarged view illustrating a portion of a cross section of the washing unit.

FIG. 17 is an enlarged view illustrating a portion of a front surface of the washing unit 130. FIG. 18 is an enlarged view illustrating a portion of a cross section of the washing unit 130.

A detergent inlet 1312 and a rinse inlet 1311 may be formed on a side surface of the tub 131 by passing through the tub 131.

Detergent may flow into the detergent inlet 1312. The detergent inlet 1312 may be connected to the detergent injection part 138 using a pipe so that detergent discharged from the detergent injection part 138 may flow into the tub 131 through the detergent inlet 1312.

The rinse inlet 1311 may be disposed to be spaced apart from the detergent inlet 1312, and rinse may flow into the rinse inlet 1311. The rinse inlet 1311 may be connected to the rinse injection part 139 using a pipe so that rinse discharged from the rinse injection part 139 may flow into the tub 131 through the rinse inlet 1311.

The detergent and the rinse introduced from the detergent inlet 1312 and the rinse inlet 1311 may be at least partially adsorbed by the inner wall of the tub 131 and may flow down along the inner wall of the tub 131 due to gravity. It is difficult to mix the detergent and the rinse flowing down along the inner wall of the tub 131 with the water inside the tub 131. Therefore, a structure in which detergent and rinse are effectively mixed with water is required.

To this end, the first spray nozzle 310 may be disposed under the detergent inlet 1312 and the rinse inlet 1311. The second spray holes 3121 provided in the first spray nozzle 310 may spray water in the lateral direction of the tub 131. Therefore, the water sprayed from the second spray holes 3121 may collide with the inner wall of the tub 131.

Since the first spray nozzle 310 is disposed under the detergent inlet 1312 and the rinse inlet 1311, the detergent and the rinse flowing down along the inner wall of the tub 131 downward from the detergent inlet 1312 and the rinse inlet 1311 may collide with the water sprayed from the second spray holes 3121.

The detergent and the rinse may be effectively mixed with the water due to the collision with the water. Therefore, it is possible to actively mix detergent or rinse with water, thereby increasing washing efficiency in the cup washer.

Figure 19:
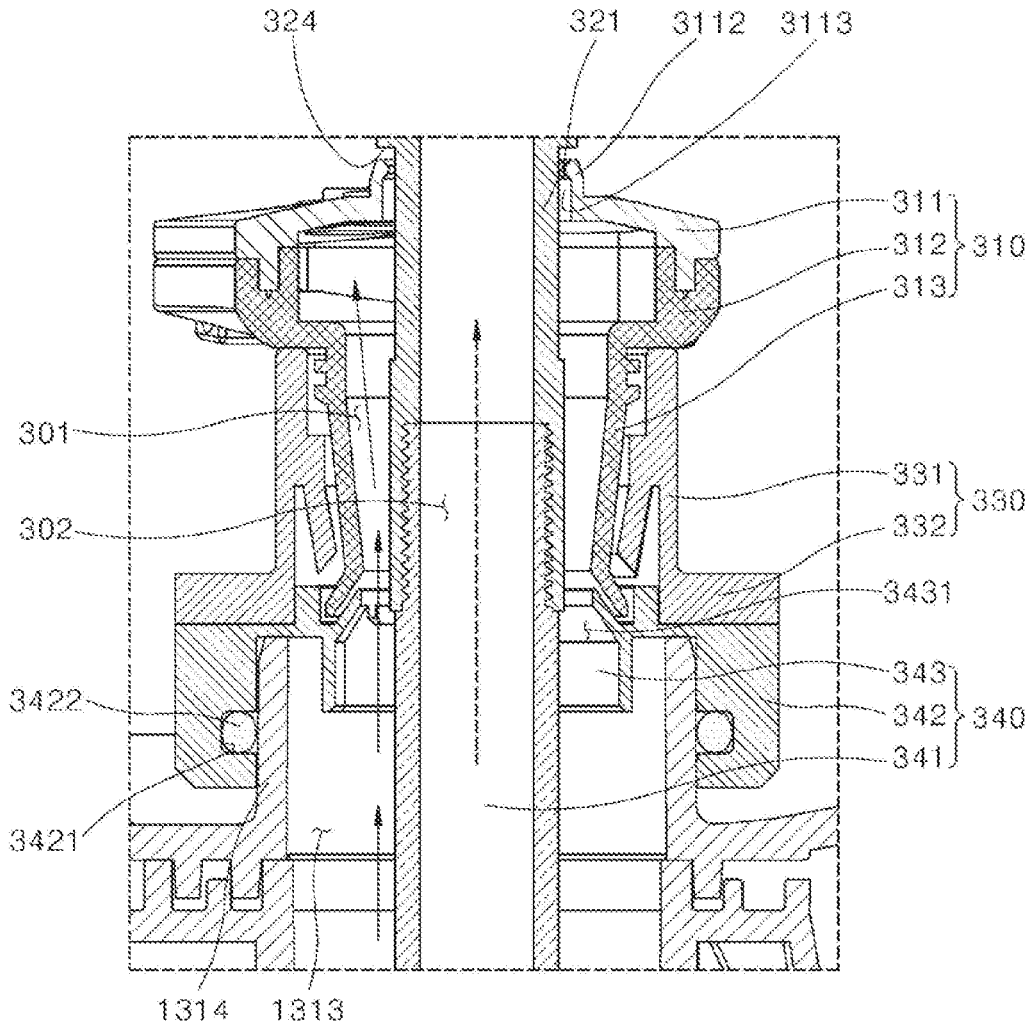
FIG. 19 is a view for describing a flow of water in a portion of the washing unit.
Figure 20:
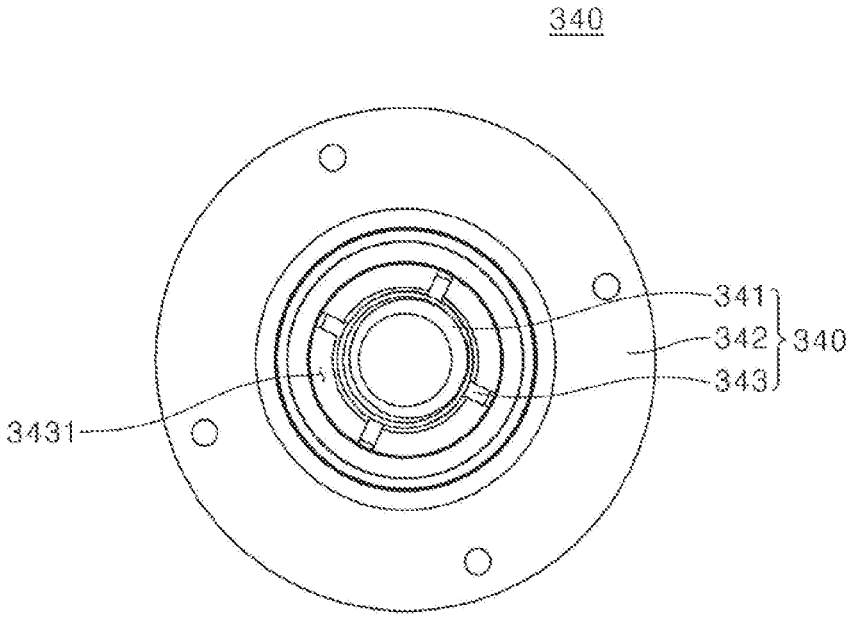
FIG. 20 is a plan view illustrating a second bracket according to one embodiment.

FIG. 19 is a view for describing a flow of water in a portion of the washing unit 130. In FIG. 19 and subsequent drawings, flow directions of water circulating in the tub 131 by the circulation pump 134 in the normal washing mode are indicated by solid line arrows. In addition, flow directions of water flowing into the tub 131 in the rapid washing mode are indicated by dashed line arrows. FIG. 20 is a plan view illustrating the second bracket 340 according to one embodiment.

As illustrated in FIG. 19, flow paths of water supplied to the first spray nozzle 310 and the second spray nozzle 320 may be partitioned, and the flow path of the water supplied to the first spray nozzle 310 may be disposed around an outer circumference of the flow path of the water supplied to the second spray nozzle 320. With this structure, the water supplied to the first spray nozzle 310 and the water supplied to the second spray nozzle 320 are not mixed with each other, and may be supplied to each nozzle and sprayed to the tub 131.

A first insertion hole 3113 into which the second spray nozzle 320 is inserted may be formed in the central portion of the first piece 311 of the first spray nozzle 310. Therefore, the first spray nozzle 310 may be rotatably coupled to the first protrusion 321 of the second spray nozzle 320.

Since the first spray nozzle 310 rotates, the first spray nozzle 310 is not tightly coupled to the second spray nozzle 320 and may be loosely coupled thereto with a certain space. Therefore, the first spray nozzle 310 may move upward of the tub 131 by the pressure of the water flowing into the first spray nozzle 310.

When the upward movement of the first spray nozzle 310 is excessive, a stable operation of the cup washer is difficult and noise may occur. Therefore, a structure of limiting the movement of the first spray nozzle 310 is required.

To this end, a stopper 3112 and a stepped surface 324 may be provided. The first piece 311 may include the stopper 3112 that surrounds the first insertion hole 3113 and protrudes upward. The stopper 3112 may be formed to surround the first insertion hole 3113 and provided in a substantially ring shape. The second spray nozzle 320 may include the stepped surface 324 formed at a position facing the stopper 3112.

A groove recessed in an outer surface of the first protrusion 321 may be formed in a portion of the first protrusion 321 of the second spray nozzle 320 on which the first spray nozzle 310 is mounted, and the first spray nozzle 310 may be positioned in the groove. By forming the recessed groove, the stepped surface 324 may be formed on the second spray nozzle 320.

When the first spray nozzle 310 moves upward by water pressure due to the inflow of water, the stopper 3112 protruding upward of the first piece 311 of the first spray nozzle 310 may be in contact with the stepped surface 324 disposed at the facing position, and thus since the first spray nozzle 310 no longer moves up, it is possible to restrict an upward movement range of the first spray nozzle 310.

With this structure, by limiting the range in which the second spray nozzle 320 moves up due to water pressure, the cup washer operates stably, and it is possible to reduce generation of noise.

The second spray nozzle 320 may be coupled to the second bracket 340 by a screw-coupling method. Therefore, the second spray nozzle 320 may be fixedly coupled to the second bracket 340 not to rotate. On the other hand, the first spray nozzle 310 may rotate around the second spray nozzle 320 and the second bracket 340.

With this structure, when the first spray nozzle 310 rotates, the first spray nozzle 310 and the second spray nozzle 320 may be in contact with each other to generate a frictional force, and due to the action of the frictional force, the second spray nozzle 320 screw-coupled to the second bracket 340 may receive a rotational force, and when this continues, the screw coupling may be loosened and thus the second spray nozzle 320 may be separated from the second bracket 340.

In order to prevent this, the first spray nozzle 310 may be provided to rotate in a direction opposite to a direction in which the screw coupling between the second spray nozzle 320 and the second bracket 340 is loosened. For example, when the direction in which the screw coupling between the second spray nozzle 320 and the second bracket 340 is tightened is clockwise, a rotation direction of the first spray nozzle 310 may be counterclockwise.

In this case, the rotation direction of the first spray nozzle 310 may be implemented by appropriately adjusting the water discharge directions of the first spray holes 3111 and the second spray holes 3121. That is, by appropriately adjusting the water discharge directions of the first spray holes 3111 and the second spray holes 3121, for example, the rotation direction of the first spray nozzle 310 may become counterclockwise. With this structure, it is possible to effectively suppress screw loosening between the second spray nozzle 320 and the second bracket 340.

The second bracket 340 may include a first body 341, a second body 342, and a third body 343. The first body 341 may be coupled to the second spray nozzle 320, and a flow path along which water sprayed through the second spray nozzle 320 flows may be formed inside the first body 341.

The first body 341 may be substantially provided in a hollow rod shape and connected to the city water supply or the water tank 120 so that water may flow therein. An upper end portion of the first body 341 may be screw-coupled to the first protrusion 321 of the second spray nozzle 320, and a lower end portion thereof may be screw-coupled to a fixed portion provided in the sump 133.

The second body 342 may extend in a diameter direction of the first body 341 and may be coupled to the tub 131. The third body 343 may connect the first body 341 to the second body 342 and include a first through hole 3431 forming a flow path communicating with the flow path forming unit 313. As illustrated in FIG. 20, the first through hole 3431 may be formed between a plurality of third bodies 343 disposed to be spaced apart from each other in a circumferential direction.

The tub 131 may include a second insertion hole 1313 and a first mounting unit 1314. The second insertion hole 1313 may be connected to the first through hole 3431, and the first body 341 may be inserted into the second insertion hole 1313. Since the second insertion hole 1313 has a larger diameter than the first body 341, water may flow through the second insertion hole 1313 to flow into the first spray nozzle 310.

The first mounting unit 1314 may be disposed to surround the second insertion hole 1313, may protrude upward, and may be equipped with the second body 342. The second body 342 may be coupled to the first mounting unit 1314, for example, by a forcibly fitting method.

It is necessary to suppress water flowing toward the first spray nozzle 310 from being discharged into the tub 131 directly through a gap between the first mounting unit 1314 and the second body 342 by coupling the first mounting unit 1314 to the second body 342.

To this end, a first mounting groove 3421 and a sealing member 3422 may be provided on the second body 342. The first mounting groove 3421 may be formed in a circumferential direction of the second body 342 to face an outer surface of the first mounting unit 1314.

The sealing member 3422 may be mounted in the first mounting groove 3421 to seal the gap between the second body 342 and the first mounting unit 1314. The sealing member 3422 may be made of a material such as a rubber or a silicone resin having excellent waterproof property and for example, provided as an O-ring.

By the sealing member 3422 sealing the gap between the first mounting unit 1314 and the second body 342, it is possible to effectively suppress a portion of the water flowing toward the first spray nozzle 310 through the gap from being discharged directly into the tub 131 or conversely, the water inside the tub 131 from flowing into the spray unit 300.

Due to the above structure, as indicated by the solid line arrows in FIG. 19, the water used in the normal washing mode may flow into the tub 131 and may be stored in the sump 133 under the tub 131 and may flow into the first spray nozzle 310 after sequentially passing through the second insertion hole 1313, the first through hole 3431, and the flow path forming unit 313 from the sump 133 and may be sprayed into the tub 131 through the first spray holes 3111 and the second spray holes 3121.

Meanwhile, as indicated by the dashed line arrows in FIG. 19, the water used in the rapid washing mode may flow into the first body 341 of the second bracket 340 through a pipe connected to the city water supply and flow back to the second spray nozzle 320 and may be sprayed into the tub through the third spray holes 3211 and the fourth spray hole 3221.

The second spray nozzle 320 may be provided to extend upward after passing through the central portion of the first spray nozzle 310. A second flow path 302 may be formed inside the second spray nozzle 320, and a first flow path 301 may be formed on the outer circumference of the second spray nozzle 320. Water flowing through the first flow path 301 may be sprayed to the tub 131 through the first spray nozzle 310, and water flowing through the second flow path 302 may be sprayed to the tub 131 through the second spray nozzle 320.

Referring to FIG. 19, the spray unit 300 may include the first flow path 301 and the second flow path 302. The first flow path 301 may be formed in a space between the outer circumference of the second spray nozzle 320 and the first spray nozzle 310. That is, the first flow path 301 may be formed between the outer surface of the second spray nozzle 320 and the inner surface of the first spray nozzle 310 and provided to surround an outer circumference of the second flow path 302. Therefore, the first flow path 301 may be provided as a substantially donut-shaped space in a cross-sectional plan view.

The first flow path 301 may be connected to the circulation pump 134 so that water introduced from the circulation pump 134 may flow. The first flow path 301 may provide a path along which water is sprayed to the tub 131. The first flow path 301 may be connected to the first spray nozzle 310.

As described above, the first flow path 301 may be formed outside the second spray nozzle 320. Water flowing through the first flow path 301 may be sprayed from the first spray nozzle 310.

In addition, the first flow path 301 may be connected to the first spray nozzle 310, and water flowing through the first flow path 301 may be sprayed to the tub 131 through the first spray nozzle 310. In the normal washing mode, water may be sprayed to the tub 131 while circulating between the tub 131 and the sump through the first flow path 301 to wash the cup.

The second flow path 302 may be formed in an internal space of the second spray nozzle 320 to be partitioned from the first flow path 301. The second flow path 302 may be provided separately from the first flow path 301, and water may flow through the second flow path 302. The second flow path 302 may provide a path along which water is sprayed to the tub 131. The second flow path 302 may be connected to the second spray nozzle 320. At least a portion of the second flow path 302 may be formed inside the second spray nozzle 320.

In addition, the second flow path 302 may be connected to the second spray nozzle 320, and the water flowing through the second flow path 302 may be sprayed to the tub 131 through the second spray nozzle 320. In the rapid washing mode, water may flow into the second flow path 302 and may be sprayed to the tub 131 through the second spray nozzle 320 to wash the cup.

With this structure, the water flowing through each of the first flow path 301 and the second flow path 302 may smoothly flow without being mixed with each other, and the first flow path 301 and the second flow path 302 may be disposed at adjacent positions, and at the same time, a volume of the entire flow path may be reduced.

In the embodiment, in the normal washing mode, water may flow through at least one of the first flow path 301 and the second flow path 302, and at least one of the first spray nozzle 310 and the second spray nozzle 320 may be used to wash the cup, and in the rapid washing mode, water flows through the second flow path 302, and the second spray nozzle 320 may be used to wash the cup.

In this case, the first flow path 301 and the second flow path 302 may be separated so that water flowing through each flow path may not be mixed. Therefore, it is possible to improve a user's convenience by operating the cup washer by clearly distinguishing between the normal washing mode and the rapid washing mode.

Figure 21:
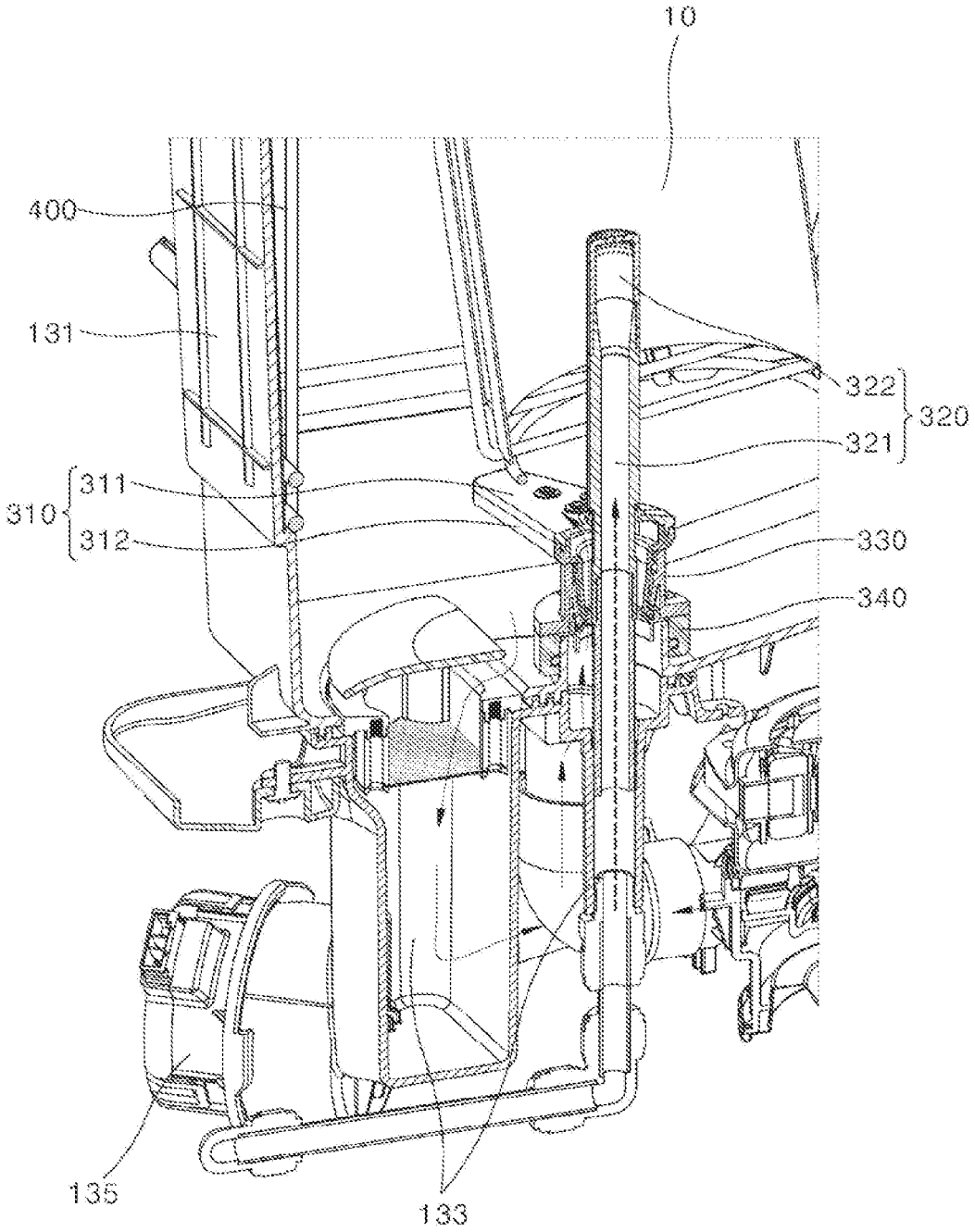
FIG. 21 is a view for describing a flow of water in the entire washing unit.

FIG. 21 is a view for describing a flow of water in the entire washing unit 130. The cup washer may be operated separately in the normal washing mode and the rapid washing mode according to a user's selection.

When the cup washer operates in the normal washing mode, water supplied from the sump 133 may be sprayed through the first spray nozzle 310. When the cup washer operates in the rapid washing mode, water may be sprayed through the second spray nozzle 320.

In the normal washing mode, the cup may be washed by spraying water while the first spray nozzle 310 rotates. In the normal washing mode, water flowing into the tub 131 may be stored in the sump 133 disposed under the tub 131, and the water stored in the sump 133 may be sprayed through the first spray nozzle 310 to perform washing. In addition, in the normal washing mode, water may also be sprayed from the second spray nozzle 320 together with the first spray nozzle 310 to perform washing.

In the rapid washing mode, the second spray nozzle 320 may spray water to wash the cup. In the rapid washing mode, water at room temperature may flow into the second spray nozzle 320 from the city water supply directly connected to the second spray nozzle 320 to perform washing.

In the normal washing mode, hot water in the sump 133 may repeatedly circulate through the sump 133 and the tub 131 by the operation of the circulation pump 134 to wash the cup. In addition, in the normal washing mode, since detergent and rinse flow into the tub 131, a washing result may be better than in the rapid washing mode, and a rinsing process using the rinse may be performed.

In the normal washing mode, the circulation pump 134 may be operated to circulate hot water. When the circulation pump 134 operates, as indicated by the solid line arrows in FIG. 21, hot water heated in the water tank 120 and stored in the sump 133 may be sprayed into the tub 131 after passing through the circulation pump 134 and the spray unit 300 through the connected pipe, and the sprayed hot water may be re-stored in the sump 133.

Therefore, the hot water may wash the cup while repeatedly performing the flowing process of circulating through the sump 133, the spray unit 300, and the tub 131. After finishing washing the cup, water may be discharged to the outside of the cup washer by the drain pump 135.

In the rapid washing mode, the circulation pump 134 does not operate, the water flowing into the second flow path 302 may flow due to the water pressure, and water may be sprayed from the second spray nozzle 320. In the rapid washing mode, cup washing may be completed very quickly.

In the rapid washing mode, the flows of water are as indicated by the dashed line arrows in FIG. 21. After finishing washing the cup, water may be stored in the sump 133 and discharged to the outside of the cup washer by the drain pump 135 like in the normal washing mode.

In the embodiment, in the normal washing mode, the first spray nozzle 310 may be used to wash the cup, and in the rapid washing mode, the second spray nozzle 320 may be used to wash the cup. At this time, flow paths of water in each mode may be separated. As described above, since the cup washer is operated separately in the normal washing mode and the rapid washing mode, it is possible to improve a user's convenience.

Figure 22:
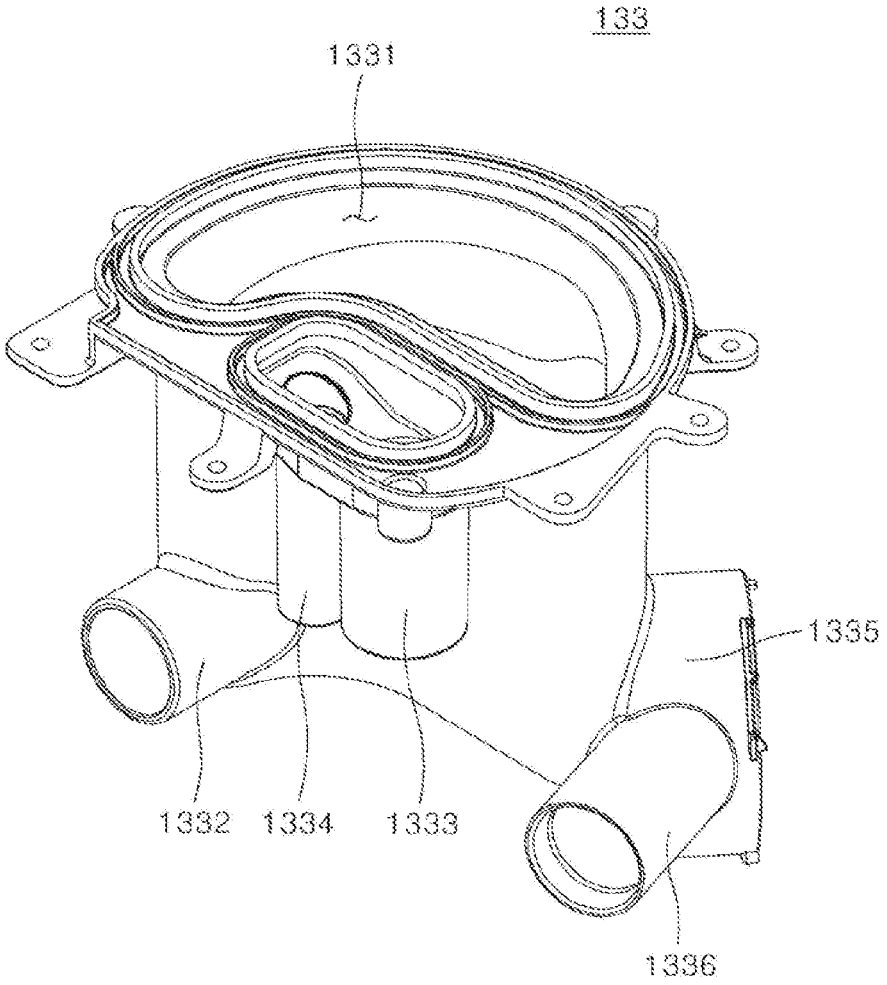
FIG. 22 is a perspective view illustrating a sump according to one embodiment.
Figure 23:
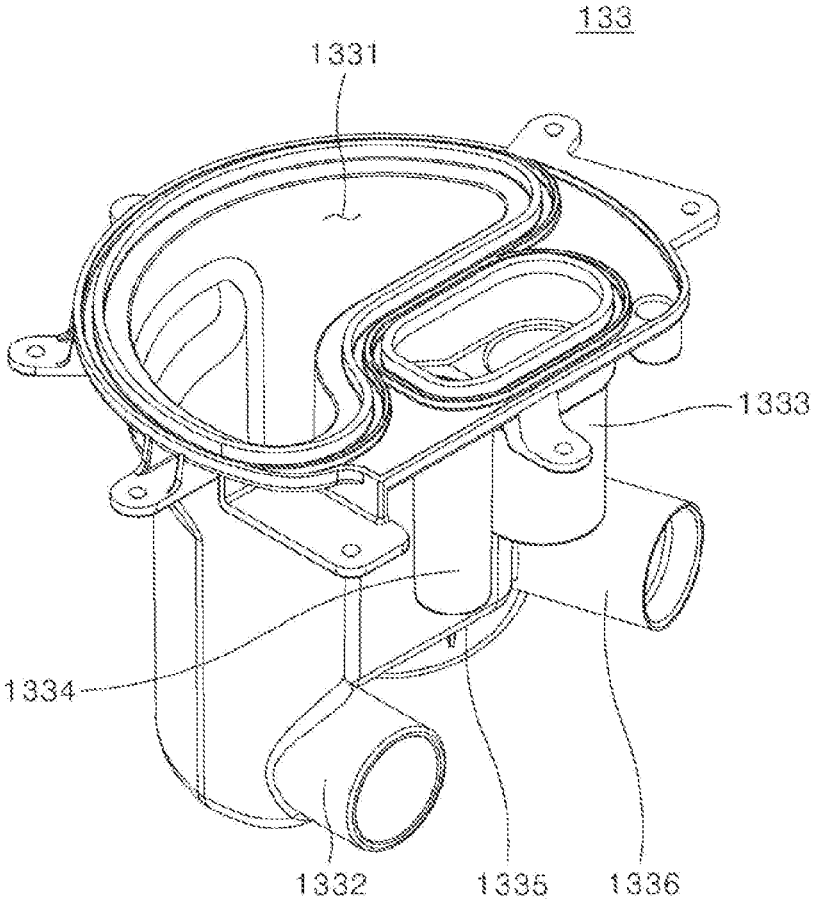
FIG. 23 is a view illustrating the sump of FIG. 22 in another direction.

FIG. 22 is a perspective view illustrating the sump 133 according to one embodiment. FIG. 23 is a view illustrating the sump of FIG. 22 viewed in another direction. The sump 133 may be connected to the tub 131, and water may be stored in the sump 133 when the cup washer operates in the normal washing mode. When the washing pump operates, water may be sprayed through the first spray nozzle 310 while circulating in the sump 133 and the tub 131 to wash the cup accommodated in the tub 131.

Commonly in the normal washing mode and the rapid washing mode, the water used for washing, after the cup washing is finished, may be stored in the sump 133 and discharged to the outside of the cup washer by the drain pump 135 connected to the sump 133. The sump 133 may include a storage space 1331, an inlet connection unit 1332, a first nozzle connection unit 1333, a second nozzle connection unit 1334, a pump casing 1335, and a drain connection unit 1336.

The storage space 1331 may be formed as a space inside the sump 133 to store water. Hot water may be stored in the storage space 1331 in the normal washing mode. In addition, the storage space 1331 may store water containing filth after washing is completed in the normal washing mode or the rapid washing mode. The water containing filth may be drained to the outside by the drain pump 135.

The inlet connection unit 1332 may be connected to the storage space 1331 and connected to an inlet of the circulation pump 134. The inlet connection unit 1332 may protrude from the sump 133 and have an end portion coupled to the circulation pump 134. When the circulation pump 134 operates, water may flow into the circulation pump 134 from the sump 133 through the inlet connection unit 1332. The circulation pump 134 may operate in the normal washing mode.

The first nozzle connection unit 1333 may be connected to an outlet of the circulation pump 134 and connected to the first flow path 301 and the first spray nozzle 310. Therefore, the water discharged from the circulation pump 134 may flow through the first nozzle connection unit 1333, the first flow path 301, and the first spray nozzle 310 and may be sprayed into the tub 131.

The second nozzle connection unit 1334 may be connected to the second flow path 302 and the second spray nozzle 320. One side of the second nozzle connection unit 1334 may be connected to the water tank 120 or a city water supply pipe 80, and the other side thereof may be connected to the second spray nozzle 320 and the second flow path 302 formed inside the second spray nozzle 320. Therefore, the water flowing into the cup washer from the water tank 120 or the city water supply pipe 80 may flow through the second flow path 302 and the second spray nozzle 320 and may be sprayed into the tub 131.

The pump casing 1335 may be connected to the storage space 1331 and equipped with the drain pump 135. The pump casing 1335 may be integrally formed with the sump 133. Therefore, the water in the sump 133 may be drained to the outside of the cup washer by the drain pump 135 mounted on the pump casing 1335.

The drain connection unit 1336 may be connected to the pump casing 1335 and connected to the drain pipe. The drain connection unit 1336 may protrude from the pump casing 1335 and may be integrally formed with the pump casing 1335. When the drain pump 135 operates, the contaminated water stored in the sump 133 may flow through the drainage connection unit 1336 and the pipe connected thereto and may be drained to the outside of the cup washer.

Figure 24:
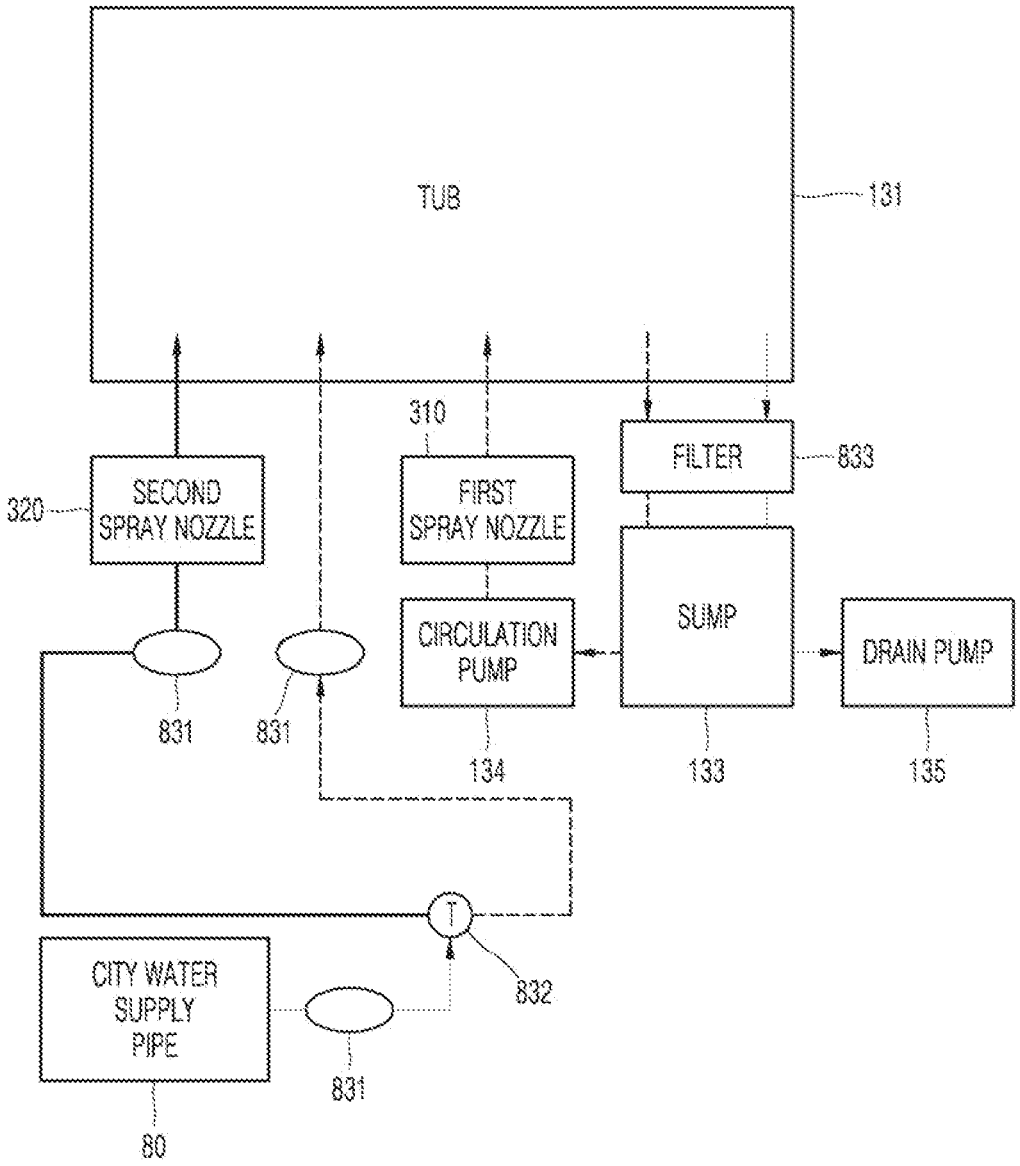
FIG. 24 is a schematic diagram illustrating a piping and instrumentation structure of the cup washer according to one embodiment.

FIG. 24 is a schematic diagram illustrating a piping and instrumentation structure of the cup washer according to one embodiment. In FIG. 24, a structure of the cup washer not including the water tank 120 is disclosed. In FIG. 24 and subsequent drawings, in the rapid washing mode, flow paths through which water flows are indicated by thick solid lines, and in the normal washing mode, flow paths through which water flows are indicated by dashed lines.

The pipe connected to the city water supply pipe 80 may branch into a pipe connected to the second spray nozzle 320 and a pipe connected to a washing water inlet 1315 of the tub 131. For a configuration of these pipes, a three-way fitting 832 may be provided at one side of the city water supply pipe 80.

In addition, a filter 833 for filtering filth contained in water in a cup washing process may be provided on a portion in which the sump 133 and the tub 131 are connected. The filter 833 can suppress filth from flowing into the circulation pump 134 or the drain pump 135 to protect these pumps and suppress the filth from being re-sprayed through the first spray nozzle 310 to contaminate the cup accommodated in the tub 131.

In the city water supply pipe 80, valves 831 may be provided at appropriate positions of the pipes to adjust a flow of water in the pipe connected to the second spray nozzle 320 or the pipe connected to the washing water inlet 1315. The controller provided on the cup washer may control the flow of water according to the normal washing mode or the rapid washing mode by controlling the opening and closing of each valve 831.

In the normal washing mode, water may flow into the tub 131 from the city water supply pipe 80 through the washing water inlet 1315 and may be stored in the sump 133 disposed under the tub 131. When the cup washer operates in the normal washing mode, the circulation pump 134 may be operated to spray water to the tub 131 through the first spray nozzle 310 and flow while circulating in the sump 133 and the tub 131. In the normal washing mode, after washing is completed, the contaminated water may be re-stored in the sump 133.

When the cup washer operates in the rapid washing mode, the operation of the circulation pump 134 may be stopped, and water may be sprayed to the tub 131 through the second spray nozzle 320.

When the cup washer operates in the normal washing mode, the water introduced from the city water supply pipe 80 may flow into the tub 131 through the washing water inlet 1315, may be stored in the sump 133, and then sprayed to the tub 131 through the first spray nozzle 310. When the cup washer operates in the rapid washing mode, the water introduced from the city water supply pipe 80 may be sprayed to the tub 131 through the second spray nozzle 320.

In the rapid washing mode, water may be sprayed into the tub 131 from the city water supply pipe 80 through the second spray nozzle 320 in a state of being not stored in the sump 133 to perform washing. In the rapid washing mode, after washing is completed, the contaminated water may be stored in the sump 133.

In the normal washing mode or the rapid washing mode, after washing is completed, the water stored in the sump 133 may be discharged to the outside through the drain pump 135.

Figure 25:
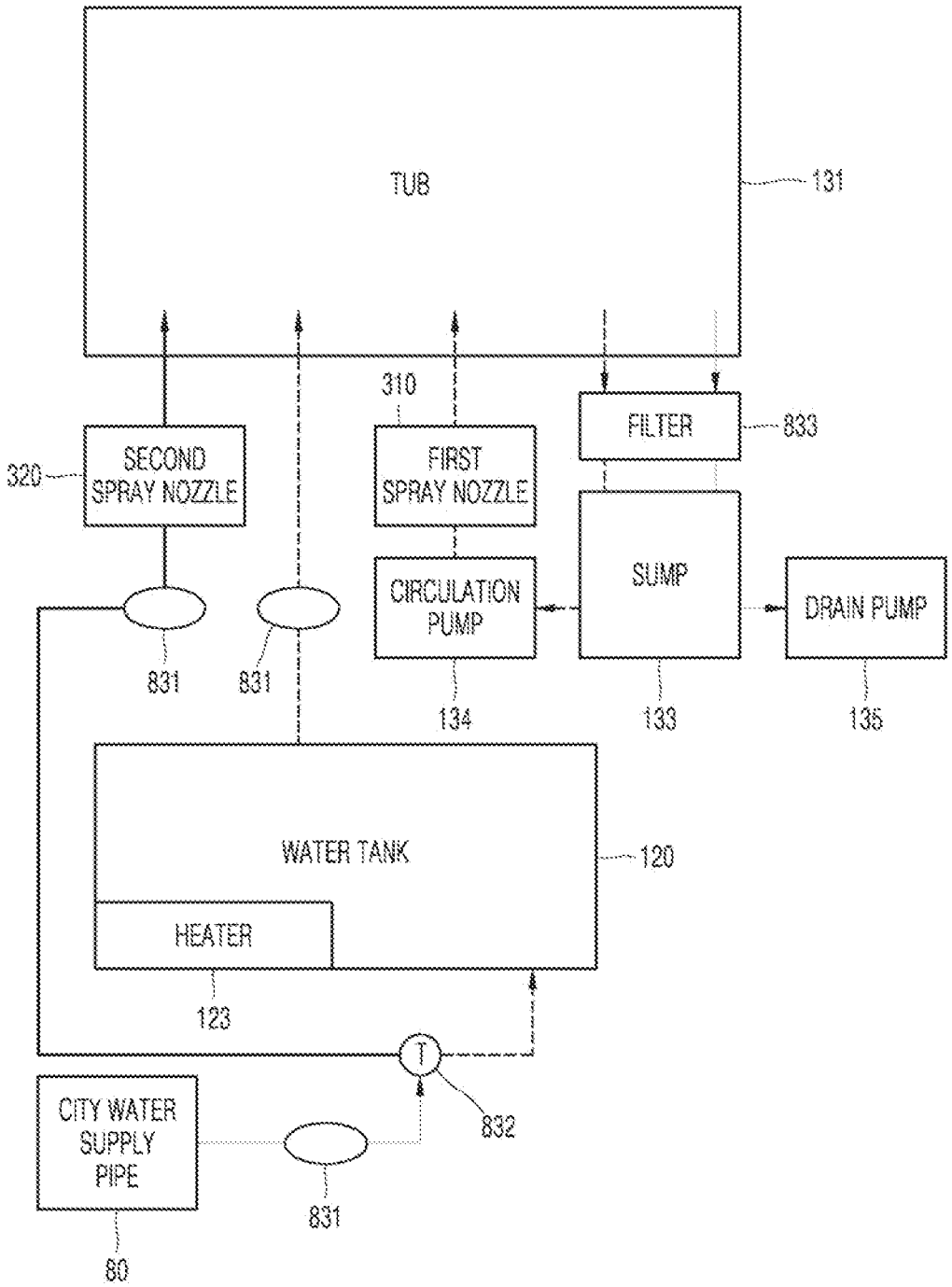
FIG. 25 is a schematic diagram illustrating a piping and instrumentation structure of a cup washer according to another embodiment.

FIG. 25 is a schematic diagram illustrating a piping and instrumentation structure of a cup washer according to another embodiment. The cup washer illustrated in FIG. 25 may include the water tank 121 connected to the city water supply pipe 80 and the tub 131 with pipes to store water introduced from the city water supply pipe 80 and having a heater 123 for heating the stored water embedded therein.

In the normal washing mode, since water is heated in the water tank 120 and flows into the tub 131 to wash the cup, it is possible to increase washing efficiency of the cup washer by washing with hot water.

When the cup washer operates in the normal washing mode, the water introduced from the city water supply pipe 80 may be heated in the water tank 120 to flow into the tub 131 through the washing water inlet 1315, stored in the sump 133, and then sprayed to the tub 131 through the first spray nozzle 310.

When the cup washer operates in the rapid washing mode, the water introduced from the city water supply pipe 80 may be sprayed to the tub 131 through the second spray nozzle 320 after bypassing the water tank 120.

In the rapid washing mode, a washing time is relatively shorter than that of the normal washing mode. In addition, in the rapid washing mode, washing efficiency in a case of performing washing using water at room temperature may be lower than that in a case of performing washing using hot water. Therefore, a structure of increasing washing efficiency in the rapid washing mode is required, which will be described below.

Figure 26:
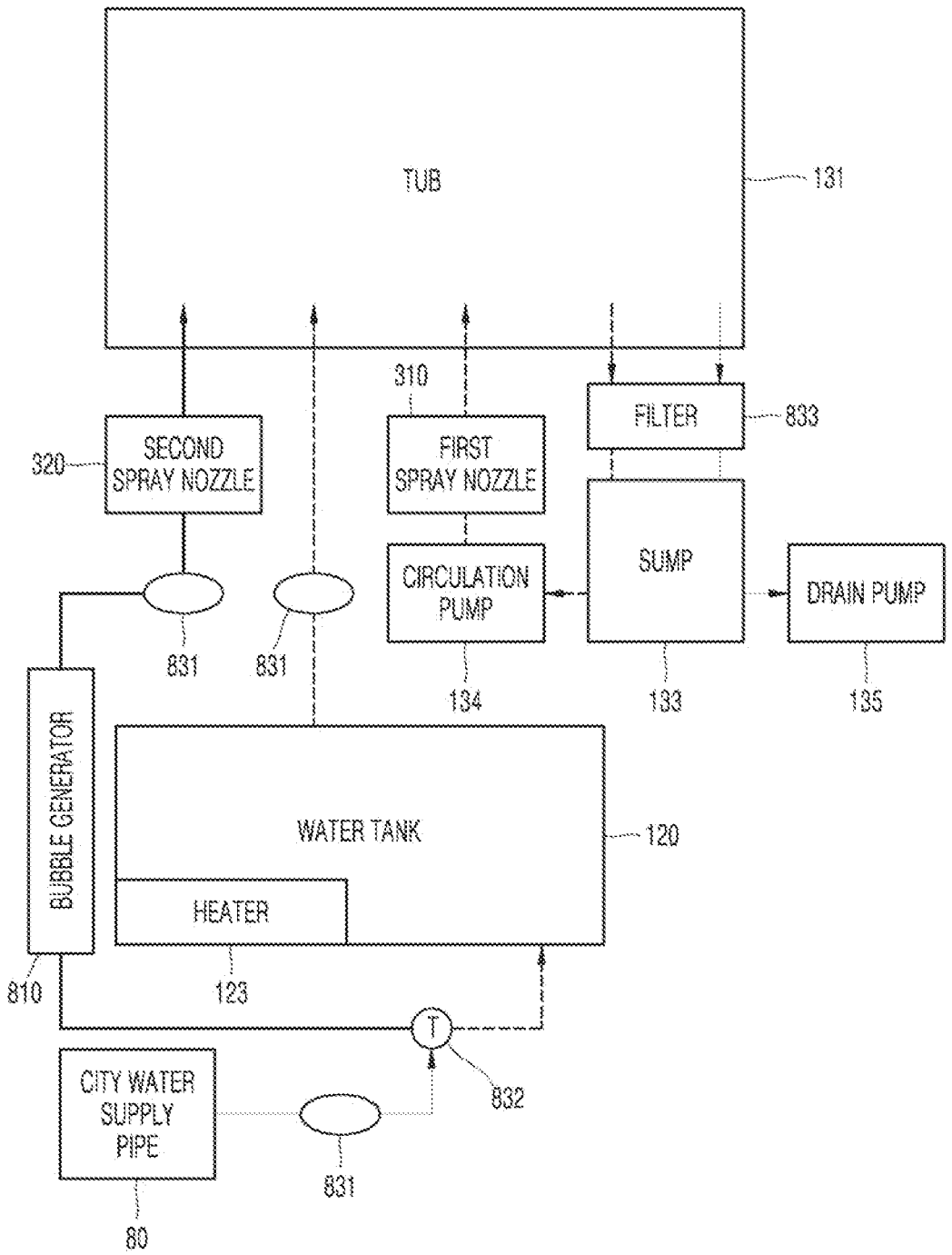
FIG. 26 is a schematic diagram illustrating a piping and instrumentation structure of a cup washer according to still another embodiment.

FIG. 26 is a schematic diagram illustrating a piping and instrumentation structure of a cup washer according to still another embodiment. In the normal washing mode, washing may be performed in the manner described above with reference to FIG. 25.

In the embodiment illustrated in FIG. 26, the cup washer may include a bubble generator 810 disposed in the pipe connecting the city water supply pipe 80 to the second spray nozzle 320. The bubble generator 810 may be disposed between the city water supply pipe 80 and the second flow path 302 to which the second spray nozzle 320 is connected, and the water introduced from the city water supply may pass through the bubble generator 810.

When the cup washer operates in the rapid washing mode, the water introduced from the city water supply pipe 80 may be sprayed to the tub 131 through the second spray nozzle 320 after passing through the bubble generator 810.

Since the water passing through the bubble generator 810 may include bubbles and the water including the bubbles is sprayed to the cup, it is possible to increase the washing efficiency of the cup washer in the rapid washing mode in which water at room temperature is used.

Figure 27:
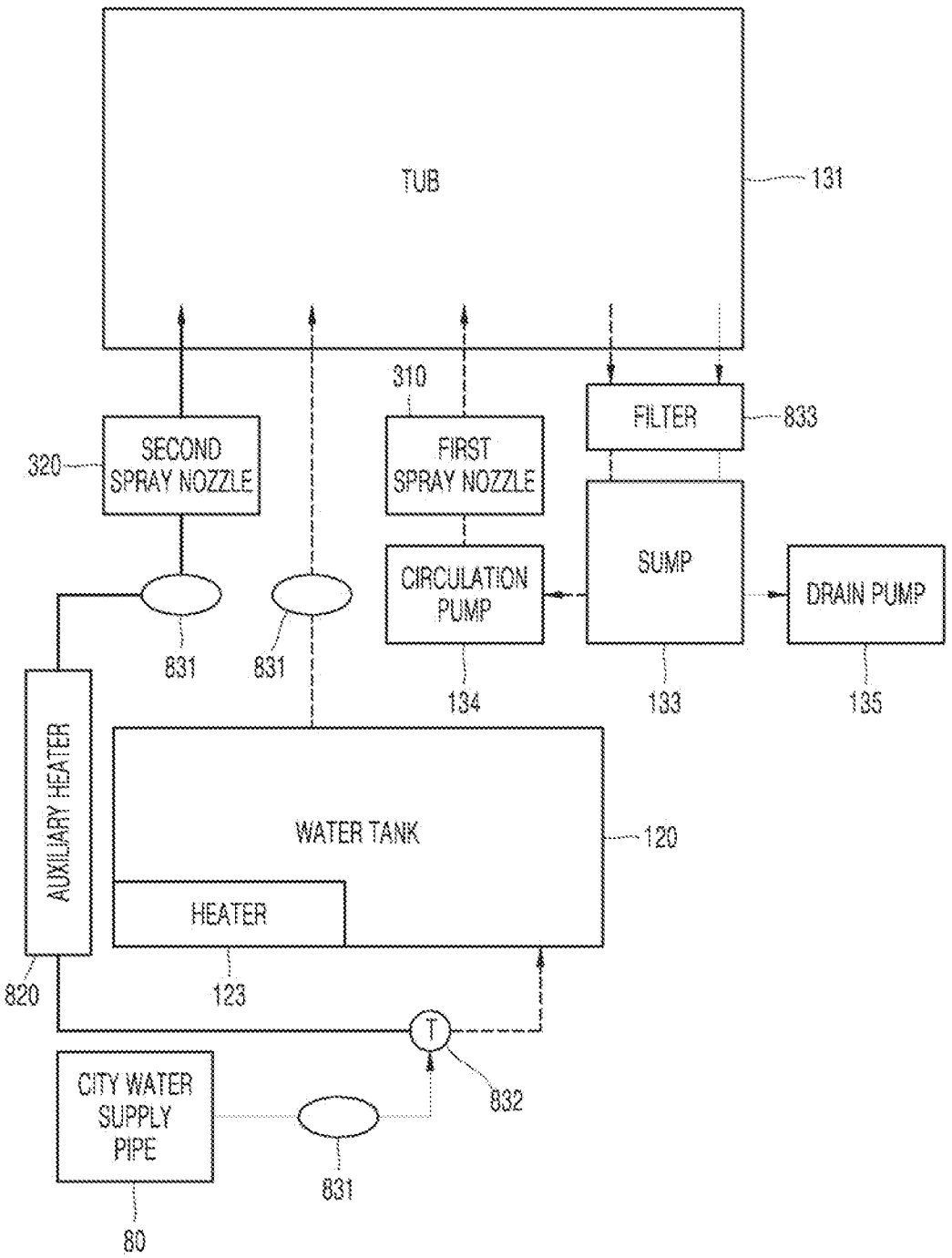
FIG. 27 is a schematic diagram illustrating a piping and instrumentation structure of a cup washer according to yet another embodiment.

FIG. 27 is a schematic diagram illustrating a piping and instrumentation structure of a cup washer according to yet another embodiment. The cup washer may include an auxiliary heater 820 disposed on the pipe connecting the city water supply pipe 80 to the second spray nozzle 320.

When the cup washer operates in the rapid washing mode, the water introduced from the city water supply pipe 80 may be heated while passing through the auxiliary heater 820 and sprayed to the tub 131 through the second spray nozzle 320.

Therefore, since the hot water heated by the auxiliary heater 820 is sprayed by the second spray nozzle 320 in the rapid washing mode, it is possible to further increase the washing efficiency of the cup washer in the rapid washing mode than that of a case of using water at room temperature.

Meanwhile, the cup washer may include the bubble generator 810 and the auxiliary heater 820 together, and the bubble generator 810 and the auxiliary heater 820 may be connected in series. Therefore, it is possible to further increase the washing efficiency of the cup washer in the rapid washing mode.

In the embodiment, at least one of the bubble generator 810 and the auxiliary heater 820 may be provided on the pipe connecting the city water supply pipe 80 to the second spray nozzle 320. Therefore, since the water sprayed from the second spray nozzle 320 includes bubbles or is hot water, or is at least one state in the rapid washing mode, it is possible to effectively increase the washing efficiency of the cup washer in the rapid wash mode.

Figure 28:
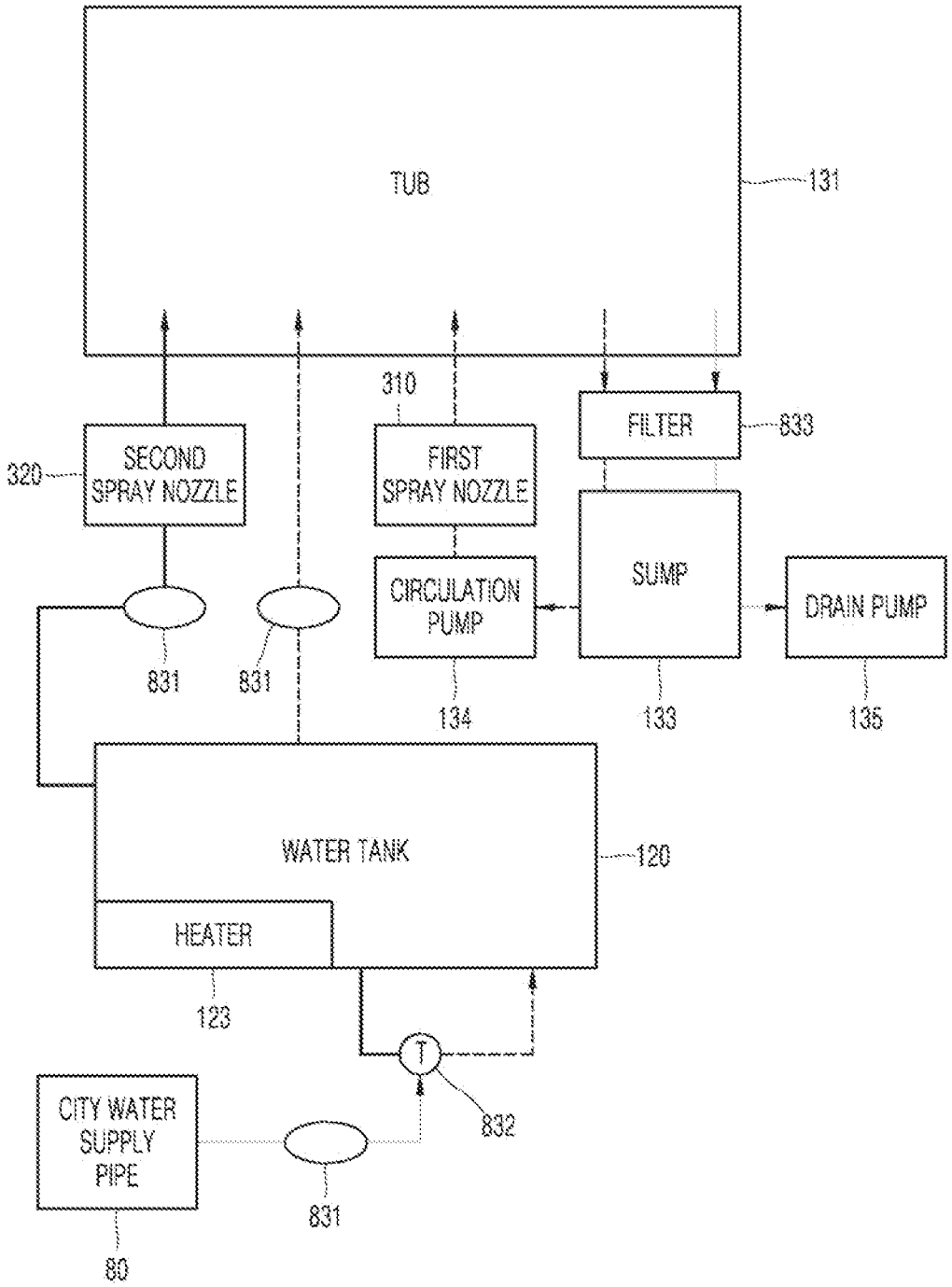
FIG. 28 is a schematic diagram illustrating a piping and instrumentation structure of a cup washer according to yet another embodiment.

FIG. 28 is a schematic diagram illustrating a piping and instrumentation structure of a cup washer according to yet another embodiment. In the embodiment illustrated in FIG. 28, both the water supplied to the first spray nozzle 310 and the second spray nozzle 320 may be introduced through the water tank 120.

In this case, the second spray nozzle 320 and the water tank 120 may be connected using a pipe. In addition, in order to increase the pressure of the water supplied to the second spray nozzle 320, if necessary, a pump may be disposed on the pipe connecting the second spray nozzle 320 to the water tank 120.

In the embodiment illustrated in FIG. 28, water at room temperature may be supplied to the second spray nozzle 320 by stopping the operation of the heater 123 in the rapid washing mode. Alternatively, by operating the heater 123 in the rapid washing mode, the cup may also be washed using hot water in the rapid washing mode.

As described above, both the water supplied to the first spray nozzle 310 and the second spray nozzle 320 in the rapid washing mode and the normal washing mode may be introduced from the water tank 120. In this case, a pipe structure for direct connection between the city water supply and the second spray nozzle 320 may be omitted. In addition, in this case, there is an advantage in that the cup may be washed by making hot water using the heater 123 even in the rapid washing mode.

In addition, in another embodiment, an ultrasonic module may be provided in the washing unit 130. For example, the ultrasonic module may be mounted inside the tub 131. For example, the ultrasonic module operates in the rapid washing mode to apply ultrasonic waves to the water sprayed from the second spray nozzle 320, thereby improving the washing effect.

Considering the piping and instrumentation structure of the cup washer of the above-described embodiment, the cup washer may implement the following structure and operation.

The first spray nozzle 310 may be connected to the first flow path 301, and the second spray nozzle 320 may be connected to the second flow path 302. Therefore, the first flow path 301 and the second flow path 302 may receive water from at least one of the city water supply or the water tank 120.

Specifically, in one embodiment, both the first flow path 301 and the second flow path 302 may receive water from the city water supply. In another embodiment, the first flow path 301 and the second flow path 302 may receive water from the water tank 120. In still another embodiment, the first flow path 301 may receive water from the water tank 120, and the second flow path 302 may receive water from the city water supply. In this case, at least one of water at room temperature or hot water may be supplied to each of the first flow path 301 and the second flow path 302.

As described above, the cup washer may operate in any one of the normal washing mode and the rapid washing mode that requires a shorter time than in the normal washing mode. A detailed operation in each mode is as follows.

Water at room temperature or hot water may be supplied to the spray unit 300 in the normal washing mode and the rapid washing mode. It is possible to further increase the washing efficiency in the case of washing the cup using hot water than that of the case of washing the cup using water at room temperature. When the cup is washed with water at room temperature, it is possible to reduce power consumption of the cup washer required to heat water. In addition, when the cup is washed with water at room temperature, it is possible to increase the washing efficiency using the bubble generator 810 or the ultrasonic module.

In one embodiment, when the cup washer operates in the normal washing mode, water may be supplied to the first flow path 301, and the first spray nozzle 310 may be operated to wash the cup.

In another embodiment, when the cup washer operates in the normal washing mode, since water may be supplied to the first flow path 301 and the second flow path 302 and the first spray nozzle 310 and the second spray nozzle 320 may be operated together to wash the cup, it is possible to further increase the washing efficiency than that of the case in which only the first spray nozzle 310 is operated.

In still another embodiment, when the cup washer operates in the rapid washing mode, water may be supplied to the second flow path 302 and may not be supplied to the first flow path 301. In the rapid washing mode, the second spray nozzle 320 may operate, and the first spray nozzle 310 may not operate. In the rapid washing mode, it is possible to significantly reduce the washing time by washing the cup using only the second spray nozzle 320 without using the first spray nozzle 310 in a circulation flow method.

Since the washing time is relatively short in the rapid washing mode, it may be appropriate to set the pressure of the water flowing through the second flow path 302 and the second spray nozzle 320 in the rapid washing mode to be higher than the pressure of the water flowing through the respective flow paths and spray nozzles in the normal washing mode in order to increase the washing efficiency.

Although the present disclosure has been described above with reference to exemplary drawings, the present disclosure is not limited by the embodiments and drawings disclosed in the specification, and it is apparent that various modifications can be made by those skilled in the art within the scope of the technical spirit of the present disclosure. In addition, even when the operational effects according to the configuration of the present disclosure have not been explicitly described in the description of the embodiments of the present disclosure, it goes without saying that the effects predictable by the corresponding configuration should be recognized.

What is claimed is:

1. A cup washer comprising:

a tub having a space configured to accommodate a cup therein; and a sprayer located at the tub, the sprayer being configured to spray water toward the cup, the sprayer including:

a first spray nozzle including at least one spray hole; and a second spray nozzle extending in a vertical direction, the second spray nozzle including at least one spray hole;

a first bracket, the first spray nozzle being rotatably coupled to the first bracket; and a second bracket coupled to a lower portion of the tub to mount the sprayer on the tub, the second spray nozzle being fixedly coupled to the second bracket.

2. The cup washer of claim 1, wherein the first spray nozzle extends away from an outer circumference of the second spray nozzle toward opposite side surfaces of the tub, the first spray nozzle being configured to rotate around the second spray nozzle, and wherein the first bracket is coupled to the second bracket.

3. The cup washer of claim 2, wherein the first spray nozzle includes:

a first piece defining an upper portion of the first spray nozzle; and a second piece defining a lower portion of the first piece, the second piece being coupled to the first piece to define a space in which a first portion of the water flows.

4. The cup washer of claim 3, wherein the first spray nozzle includes a connector protruding downward from the second piece, the connector surrounding at least a portion of the second spray nozzle, the connector being configured to define a flow path along which a first portion of the water flows into the first spray nozzle, and wherein the first bracket includes;

a first coupler having a hole into which the connector is inserted, the first coupler surrounding the connector; and a second coupler extending in a diametrical direction of the first coupler, the second coupler being coupled to the second bracket.

5. The cup washer of claim 4, wherein a central portion of the first piece of the first spray nozzle includes a first insertion hole configured to receive the second spray nozzle, wherein the first piece includes a stopper surrounding the first insertion hole, the stopper protruding upward, and wherein the second spray nozzle includes a stepped surface opposite the stopper.

6. The cup washer of claim 5, wherein the second bracket includes:

a first body coupled to the second spray nozzle, the first body defining a flow path along which a second portion of the water flows into the second spray nozzle;

a second body extending in a diametrical direction of the first body, the second body being coupled to the tub; and a third body connecting the first body to the second body, the third body having a first through hole in communication with the connector of the first spray nozzle, and wherein the tub includes:

a second insertion hole in communication with the first through hole, the first body of the second bracket being received in the second insertion hole; and a first mounting member surrounding the second insertion hole, the first mounting member protruding upward, the second body being coupled to the first mounting member.

7. The cup washer of claim 1, wherein the at least one spray hole of the first spray nozzle includes a plurality of first spray holes located in an upper surface thereof, the first spray holes being spaced apart from each other at positions outward from a rotation center of the first spray nozzle, the first spray holes being configured such that water discharge directions of the first spray holes are inclined with respect to the upper surface.

8. The cup washer of claim 7, wherein the at least one spray hole of the first spray nozzle includes a plurality of second spray holes located in a lower surface thereof, the second spray holes being spaced apart from each other at positions outward from the rotation center thereof, the second spray holes being disposed such that water discharge directions of the second spray holes are positioned in opposite directions based on the rotation center of the first spray nozzle.

9. The cup washer of claim 1, wherein the second spray nozzle extends beyond an upper surface of the first spray nozzle.

10. The cup washer of claim 1, wherein the second spray nozzle includes:

a first protruding portion protruding upward from the first spray nozzle; and a second protruding portion coupled to the first protruding portion, the second protruding portion protruding upward from the first protruding portion, and wherein the at least one spray hole of the second spray nozzle includes:

a plurality of third spray holes spaced apart from each other in a circumferential direction in the first protruding portion; and at least one fourth spray hole in an upper end portion of the second protruding portion.

11. The cup washer of claim 10, wherein the second spray nozzle includes an upper cover at an upper end of the second protruding portion, and wherein the at least one fourth spray hole includes:

a plurality of first sub spray holes spaced apart from each other in a circumferential direction of a sidewall of the second protruding portion; and a plurality of second sub spray holes spaced apart from each other in a diameter direction and a circumferential direction of the upper cover.

12. The cup washer of claim 1, wherein the second spray nozzle extends through a central portion of the first spray nozzle, wherein the first spray nozzle is connected to a first flow path to allow a first portion of the water to flow therethrough, and wherein the second spray nozzle is connected to a second flow path to allow a second portion of the water to flow therethrough, the second flow path being separate from the first flow path.

13. The cup washer of claim 12, wherein the first flow path is defined between an outer surface of the second spray nozzle and an inner surface of the first spray nozzle such that the first flow path surrounds the second flow path.

14. The cup washer of claim 12, further comprising a rack inside the tub, the rack being configured to support the cup, wherein at least a portion of the second spray nozzle extends through a lower end of the rack.

15. The cup washer of claim 14, wherein, when the cup is seated on the rack, at least portions of opposite end portions of the first spray nozzle are disposed outside the cup, and at least a portion of the second spray nozzle is disposed inside the cup.

16. The cup washer of claim 15, wherein the at least one spray hole of the second spray nozzle includes a plurality of spray holes, and wherein, when the cup is seated on the rack, at least some of the plurality of spray holes of the second spray nozzle are located inside the cup.

17. A cup washer comprising:

a tub having a space configured to accommodate a cup therein; and a sprayer located at the tub, the sprayer being configured to spray water toward the cup, the sprayer including:

a second spray nozzle extending in a vertical direction, the second spray nozzle including at least one spray hole;

a first spray nozzle extending away from an outer circumference of the second spray nozzle toward opposite side surfaces of the tub, the first spray nozzle being configured to rotate around the second spray nozzle, the first spray nozzle including at least one spray hole;

a first flow path defined between the outer circumference of the second spray nozzle and the first spray nozzle; and a second flow path defined in an internal space of the second spray nozzle, the second flow path being partitioned from the first flow path, wherein the first flow path surrounds and outer circumference of the second flow path.

18. The cup washer of claim 17, further comprising a water tank disposed under the tub to store water for washing the cup, wherein the first flow path and the second flow path are configured to receive water from at least one of a city water supply or the water tank.

19. The cup washer of claim 18, wherein the first flow path is configured to receive water from the water tank, and wherein the second flow path is configured to receive water from the city water supply.

* * * * *